US011787605B2

(12) United States Patent
Layos et al.

(10) Patent No.: US 11,787,605 B2
(45) Date of Patent: Oct. 17, 2023

(54) DRINK LID FOR A CUP

(71) Applicant: DART CONTAINER CORPORATION, Mason, MI (US)

(72) Inventors: Aaron Layos, Charlotte, MI (US); Chengtao Li, Novi, MI (US); Robert Brubaker, Mason, MI (US); Jacob Purcell, Howell, MI (US); Dean Garza, Williamston, MI (US)

(73) Assignee: Dart Container Corporation, Mason, MI (US)

( * ) Notice: Subject to any disclaimer, the term of this patent is extended or adjusted under 35 U.S.C. 154(b) by 8 days.

(21) Appl. No.: 17/579,083

(22) Filed: Jan. 19, 2022

(65) Prior Publication Data

US 2022/0144505 A1 May 12, 2022

Related U.S. Application Data

(63) Continuation of application No. 16/416,391, filed on May 20, 2019, now Pat. No. 11,242,180.
(Continued)

(51) Int. Cl.
*B65D 47/08* (2006.01)
*B65D 43/06* (2006.01)

(52) U.S. Cl.
CPC ..... *B65D 47/088* (2013.01); *B65D 43/065* (2013.01); *B65D 2251/0025* (2013.01);
(Continued)

(58) Field of Classification Search
CPC ..... B65D 47/088; B65D 43/065; B65D 2251/0025; B65D 2251/0081;
(Continued)

(56) References Cited

U.S. PATENT DOCUMENTS 3,516,572 A 6/1970 Davis
3,606,074 A 9/1971 Hayes
(Continued)

FOREIGN PATENT DOCUMENTS

CA 2832644 A1 10/2012
CA 2954062 A1 1/2016
(Continued)

OTHER PUBLICATIONS

Mapka®, ERI—Eco Research Institute Ltd., http://ecobioplastics.jp/en/products/mapka.php, accessed May 17, 2019.
(Continued)

*Primary Examiner* — James N Smalley
(74) *Attorney, Agent, or Firm* — McGarry Bair PC

(57) ABSTRACT

A recloseable lid for closing an open top of a cup terminating in an annular upper edge includes a cup mount defining an annular channel configured to receive the annular upper edge of the cup and a cap having an annular side wall extending upwardly from the cup mount and terminating in a top having an annular floor spaced above the cup mount. A drink opening is disposed in the top and a plug assembly having a drink opening plug is provided. The drink opening plug can be selectively moveable between a closed position in which the drink opening plug is received within the drink opening for closing the drink opening and an open position in which the drink opening plug is not disposed within the drink opening. The lid can also include a plug retainer disposed in the cap and configured to retain the drink opening plug in the open position.

26 Claims, 23 Drawing Sheets

Related U.S. Application Data

(60) Provisional application No. 62/676,378, filed on May 25, 2018.

(52) U.S. Cl.
CPC ..... *B65D 2251/0081* (2013.01); *B65D 2251/1008* (2013.01); *B65D 2251/1016* (2013.01); *B65D 2543/00046* (2013.01); *B65D 2543/00296* (2013.01); *B65D 2543/00351* (2013.01)

(58) Field of Classification Search
CPC .... B65D 2251/1008; B65D 2251/1016; B65D 2543/00046; B65D 2543/00296; B65D 2543/00351; B65D 43/0212
See application file for complete search history.

(56) References Cited

U.S. PATENT DOCUMENTS 3,815,736 A 6/1974 Sedlak
4,202,459 A 5/1980 Deparales et al.
4,949,865 A * 8/1990 Turner ..... B65D 47/0847 220/837
5,392,949 A 2/1995 McKenna
5,678,720 A 10/1997 Van Melle
6,100,512 A 8/2000 Neculescu et al.
6,211,500 B1 4/2001 Cochran, II et al.
6,255,636 B1 7/2001 Cochran, II et al.
6,260,727 B1 7/2001 Durdon
6,274,248 B1 8/2001 Goto et al.
6,383,425 B1 5/2002 Wu et al.
6,403,936 B2 6/2002 Cochran, II et al.
6,419,105 B1 7/2002 Bruce et al.
6,419,112 B1 7/2002 Bruce et al.
6,420,689 B1 7/2002 Cochran, II et al.
6,459,075 B2 10/2002 McCarthy et al.
6,478,181 B1 11/2002 Krupa et al.
6,670,592 B2 12/2003 McCarthy et al.
6,700,106 B2 3/2004 Cochran, II et al.
6,846,533 B2 1/2005 Wu et al.
6,881,937 B2 4/2005 Swiontek
6,893,694 B2 5/2005 Wu et al.
6,905,044 B1 6/2005 Russo et al.
6,923,338 B2 8/2005 Dees et al.
7,482,053 B2 1/2009 Swiontek
7,484,638 B2 2/2009 Mazzarolo
7,513,382 B2 4/2009 Clarke et al.
D591,595 S 5/2009 Tedford, Jr.
D592,056 S 5/2009 Tedford, Jr.
7,591,393 B2 9/2009 Crudgington, Jr.
7,686,183 B2 3/2010 Ziegler
D614,954 S 5/2010 Crowell et al.
7,731,047 B2 6/2010 Ishimitsu
7,741,398 B2 6/2010 Heck
7,754,299 B2 7/2010 Wu et al.
7,767,283 B2 8/2010 Forsberg et al.
8,038,841 B2 10/2011 Matsushita
8,361,612 B2 1/2013 Komatsu
8,381,935 B1 2/2013 Buck
8,561,834 B2 10/2013 Ziegler
8,631,957 B2 1/2014 Dart et al.
8,715,449 B2 5/2014 Leser et al.
8,883,280 B2 11/2014 Leser et al.
9,067,705 B2 6/2015 Leser et al.
9,102,461 B2 8/2015 Leser et al.
9,102,802 B2 8/2015 Leser et al.
9,150,344 B2 10/2015 Euler et al.
9,174,370 B2 11/2015 Komatsu et al.
9,321,563 B1 4/2016 Bowlin
9,346,605 B2 5/2016 Leser et al.
9,358,772 B2 6/2016 Leser et al.
9,447,248 B2 9/2016 Sun et al.
9,562,140 B2 2/2017 Leser et al.
9,624,348 B2 4/2017 Leser et al.
9,642,483 B2 5/2017 Fleming
9,656,793 B2 5/2017 Leser et al.
9,688,456 B2 6/2017 Euler et al.
9,694,962 B2 7/2017 Euler et al.
9,725,202 B2 8/2017 Minnette et al.
9,731,888 B2 8/2017 Euler et al.
9,751,665 B2 9/2017 Fleming
9,758,292 B2 9/2017 Leser et al.
9,758,293 B2 9/2017 Leser et al.
9,758,655 B2 9/2017 Sun et al.
9,765,484 B2 9/2017 Wang et al.
9,783,649 B2 10/2017 Leser et al.
9,808,983 B2 11/2017 Sun
9,833,960 B2 12/2017 Crudgington
9,840,049 B2 12/2017 Contrada et al.
9,957,365 B2 5/2018 Sun et al.
9,993,098 B2 6/2018 Leser et al.
10,011,696 B2 7/2018 Leser et al.
10,023,710 B2 7/2018 Leser et al.
D828,160 S 9/2018 Baird et al.
D834,419 S 11/2018 Baird et al.
10,351,308 B1 * 7/2019 Schaefer ..... B65D 47/2018
2003/0089714 A1 * 5/2003 Dart ..... B65D 47/088 220/254.1
2003/0218017 A1 11/2003 Schmidtner et al.
2005/0224505 A1 10/2005 Brown et al.
2006/0270762 A1 11/2006 Noel
2007/0039960 A1 2/2007 Pawlik
2008/0073346 A1 * 3/2008 Zuares ..... B65D 47/141 220/780
2010/0012657 A1 1/2010 Levey
2010/0096395 A1 4/2010 Miller
2011/0233209 A1 9/2011 Tu
2012/0267368 A1 10/2012 Wu et al.
2012/0312816 A1 12/2012 Barreto et al.
2012/0318697 A1 12/2012 Stern
2012/0318806 A1 12/2012 Leser et al.
2013/0133295 A1 5/2013 Shah et al.
2014/0048552 A1 2/2014 Wang et al.
2014/0167310 A1 6/2014 Euler et al.
2014/0167311 A1 6/2014 Leser et al.
2014/0170344 A1 6/2014 Pramanik et al.
2014/0264139 A1 9/2014 Sun et al.
2015/0054189 A1 2/2015 Sun et al.
2015/0061193 A1 3/2015 Sun et al.
2015/0061194 A1 3/2015 Sun et al.
2015/0143782 A1 5/2015 Shah et al.
2015/0175762 A1 6/2015 Meli
2016/0000243 A1 1/2016 Tedford, Jr.
2016/0083570 A1 3/2016 Sun et al.
2016/0090218 A1 3/2016 Sun et al.
2016/0128907 A1 5/2016 Bagdasarian
2016/0215114 A1 7/2016 Euler et al.
2016/0236850 A1 8/2016 Leser et al.
2016/0288963 A1 10/2016 Gianfranco
2016/0355659 A1 12/2016 Sun et al.
2017/0101208 A1 4/2017 Minnette et al.
2017/0101518 A1 4/2017 Leser et al.
2017/0129228 A1 5/2017 Middlesworth et al.
2017/0182498 A1 6/2017 Matsushita
2017/0217058 A1 8/2017 Sun et al.
2017/0239874 A1 8/2017 Sun
2017/0258253 A1 9/2017 Ziegler et al.
2017/0313493 A1 11/2017 Leser et al.
2017/0313840 A1 11/2017 Leser et al.
2017/0334629 A1 11/2017 Leser et al.
2018/0009153 A1 1/2018 Sun et al.

FOREIGN PATENT DOCUMENTS

CA 2958323 A1 3/2016
CA 2947689 8/2016
CN 106905612 A 6/2017
EP 2699630 A1 2/2014
EP 2757194 B1 5/2017
EP 3164337 A1 5/2017
JP 5297702 B2 9/2013
MX 2013012104 A 5/2014
MX 2017001871 A 6/2017

(56) References Cited

FOREIGN PATENT DOCUMENTS

| | | | |
|---|---|---|---|
| TW | 201300229 | A | 1/2013 |
| WO | 2012145359 | A1 | 10/2012 |
| WO | 2016003603 | A1 | 1/2016 |
| WO | 2018098454 | A1 | 5/2018 |

OTHER PUBLICATIONS

Braskem Polypropylene Inspire 6025N Technical Sheet, www.braskem.com, Mar. 31, 2014.
Braskem Polypropylene 6025N Catalogue, www.braskem.com, Feb. 2015.
Braskem Polypropylene 6025N Catalogue, www.braskem.com, Dec. 2013.
Braskem High Melt Strength Polypropylene Brochure, www.braskem.com, accessed Feb. 23, 2018.
Brochure Elongational Testing Rheotens and Haul-Off Melt Strength Test, Gottfert, Oct. 30, 2013.

* cited by examiner

DRINK LID FOR A CUP

CROSS-REFERENCE TO RELATED APPLICATIONS

This application is a continuation of U.S. patent application Ser. No. 16/416,391, filed May 20, 2019, now U.S. Pat. No. 11,242,180, issued Feb. 8, 2022, which claims the benefit of U.S. Provisional Patent Application No. 62/676,378, filed on May 25, 2018, both of which are incorporated herein by reference in their entirety.

BACKGROUND

Disposable cups are typically provided with a drink lid to inhibit spilling the contents of the cup and to facilitate consumption of the cup contents by a consumer. Recloseable style drink lids include a feature that allows the drink opening to be closed during transport of the cup to inhibit spilling and opened to allow the consumer to consume the contents of the cup. Some recloseable lids include a drink opening plug that is attached to the lid while the drink openings of other styles of lids can be selectively closed and opened using a separate drink opening plug. Some recloseable lids include a mechanism to hold the drink opening plug in the open position to minimize interfering with the consumer's consumption of the cup contents.

Polystyrene is commonly used for forming drink lids for disposable cups, particularly cups used in hot food service. Polystyrene has a stiffness and heat resistance suitable for use in making food service articles for use in hot food service, such as coffee cup and soup bowl lids. However, polystyrene can be challenging to recycle, dissuading some consumers from purchasing products made using polystyrene. In the United States, an increasing number of municipalities are banning or placing restrictions on the use of polystyrene in food service articles due to poor public perception. Many of the alternative materials for replacing polystyrene in forming lids for disposable cups do not have the high stiffness and heat resistance that polystyrene exhibits.

BRIEF SUMMARY

According to one aspect of the present disclosure, a recloseable lid for closing an open top of a cup terminating in an annular upper edge includes a cup mount defining an annular channel configured to receive the annular upper edge of the cup and a cap having an annular side wall extending upwardly from the cup mount and terminating in a top having an annular floor spaced above the cup mount. A drink opening is disposed in the top and a plug assembly having a drink opening plug is provided. The drink opening plug can be selectively moveable between a closed position in which the drink opening plug is received within the drink opening for closing the drink opening and an open position in which the drink opening plug is not disposed within the drink opening. The lid can also include a plug retainer disposed in the cap and configured to retain the drink opening plug in the open position and at least one reinforcement structure adjacent the plug retainer.

DETAILED DESCRIPTION

Figure 1:
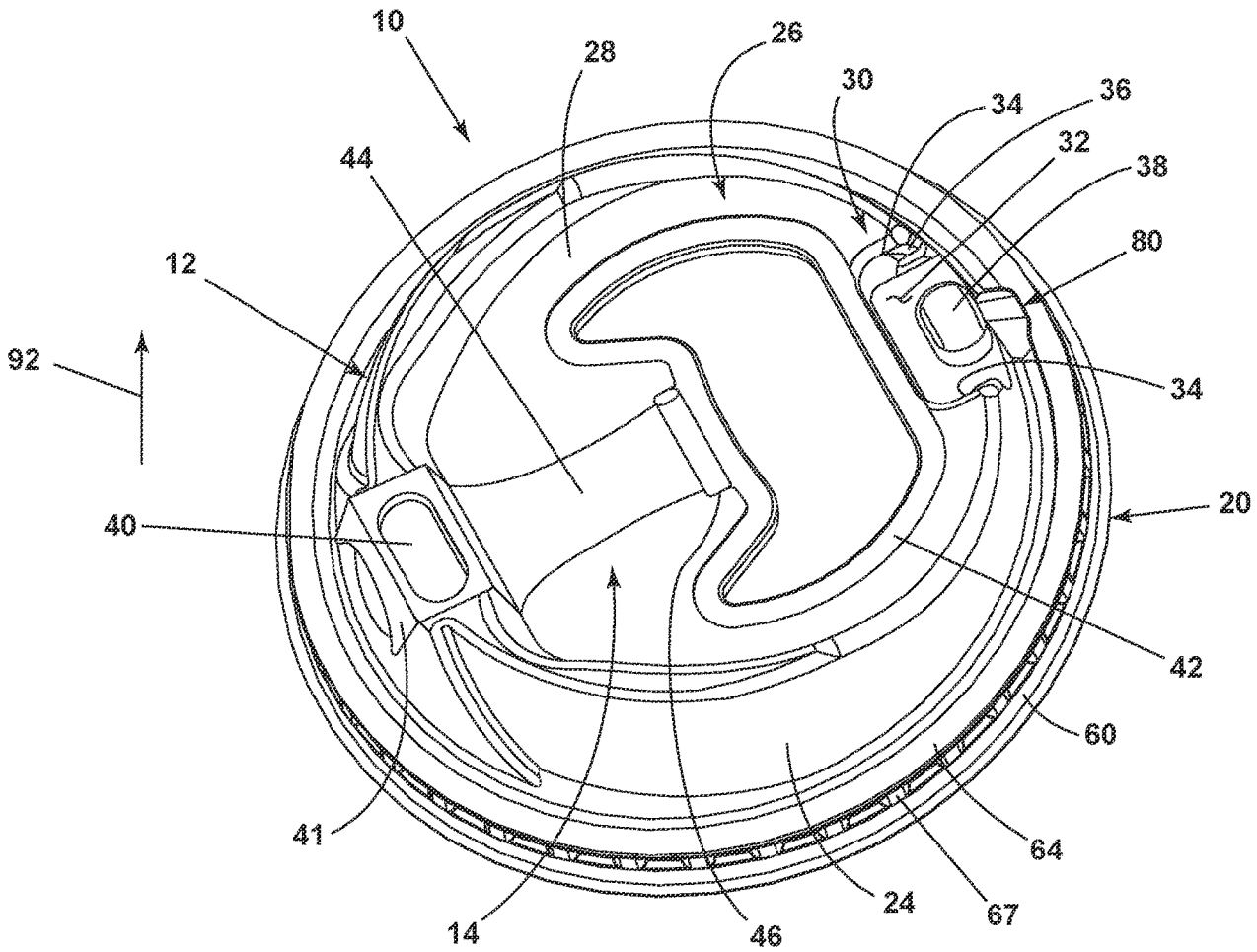
FIG. 1 is a perspective view of a recloseable lid having a drink opening plug in the closed position and a reinforcement structure according to an aspect of the present disclosure.

Aspects of the present disclosure generally relate to a drink lid for use with a cup in a food service setting, particularly a hot food service setting in which the cup is intended to hold a hot beverage or be heated in a microwave, that includes at least one reinforcement structure to facilitate engagement of a drink opening plug with a plug retainer configured to hold the drink opening plug in an open position. Recloseable style drinks lids include a drink opening plug that closes the drink opening when not in use and often include a plug retainer that holds the drink opening plug in the open position. As the drink opening plug is pressed into engagement with the plug retainer, a generally downward force is applied to the lid. If the lid does not have sufficient strength and/or rigidity (also referred to as stiffness), the lid may flex as a user attempts to press the drink opening plug into engagement with the plug retainer. This flexing of the lid may make it more challenging to engage the drink opening plug with the plug retainer. If the flexing is severe enough, the lid may become unseated from the cup on which it is mounted. Flexing of the lid in response to a downward force can become more pronounced as the lid is heated, such as when the lid is mounted on a cup holding a hot liquid (e.g., hot coffee, hot tea).

According to another aspect of the present disclosure, a drink lid includes at least one reinforcement structure to facilitate engagement of a drink opening plug with the lid drink opening. As the drink opening plug is pressed into engagement with the drink opening, a generally downward force is applied to the lid. If the lid does not have sufficient strength and/or rigidity (also referred to as stiffness), the lid may flex as a user attempts to press the drink opening plug into engagement with the drink opening. This flexing of the lid may make it more challenging to engage the drink opening plug with the drink opening. If the flexing is severe enough, the lid may become unseated from the cup on which it is mounted. Flexing of the lid in response to a downward force can become more pronounced as the lid is heated, such as when the lid is mounted on a cup holding a hot liquid (e.g., hot coffee, hot tea).

The materials used to form the lid can also effect the amount of flexing experienced by the lid when the drink opening plug is pressed into engagement with the plug retainer and/or the drink opening. Conventional cup lids for hot food service applications are often made using unexpanded high impact polystyrene (HIPS), which has a high heat deflection temperature, also referred to as high heat resistance. Hot food service temperatures are typically considered to be about 90° C. or greater. A material having a high HDT, such as HIPS, increases the resistance of the lid to heat distortion that can occur when the lid is placed on a container holding a hot liquid or when the lid is heated, such as when the container and lid are placed in a microwave for heating the contents of the container.

Polyolefins, such as polypropylene, generally have a flexural modulus less than that of HIPS, particularly at hot food service temperatures, and thus polyolefin-based lids may have a lower HDT than similar shaped HIPS lids. The lower HDT may make it more likely that the polyolefin-based lid will flex and/or distort when a user attempts to press the drink opening plug into engagement with the plug retainer or the drink opening, especially when the lid is used in a hot food service setting. Lids made from other materials having a lower HDT than polystyrene, such as polylactic acid-based materials, may also exhibit an undesirable amount of flexing and/or distortion when a user attempts to press the drink opening plug into engagement with the plug retainer or drink opening.

Aspects of the present disclosure provide reinforcement structures for use in a cup lid that facilitate engagement of the drink opening plug with the plug retainer and/or the drink opening by decreasing flexing and/or distortion experienced by the lid as the drink opening plug is pressed into engagement with the plug retainer and/or the drink opening. In one aspect, the reinforcement structures facilitate engagement of the drink opening plug with the plug retainer and/or the drink opening by redistributing at least some of the force applied to the lid when the drink opening plug is pressed into engagement with the plug retainer and/or the drink opening.

Other aspects of the present disclosure relate to providing reinforcement structures in a cup lid made using materials other than polystyrene, such as polyolefin-based or polylactic acid-based materials. Aspects of the present disclosure further relate to providing reinforcement structures in cup lids made from polyolefin-based materials having a density less than water at temperatures and pressures typically encountered in a water-based recycling stream. In one aspect, the polyolefin-based lid has a density less than 1 $g/cm^3$ at 23° C. This allows the polyolefin-based lid of the present disclosure to be recyclable using conventional practices that rely on capturing recyclable material floating in a recycling stream.

While the reinforcement structures are described in the context of drink lids for hot food service applications, it is within the scope of the present disclosure for the reinforcement structures to be used in lids intended for cold food service or both cold and hot food service applications. It is also within the scope of the present disclosure for the reinforcement structures to be used with lids other than drink lids, such as lids used with disposable bowls, for example.

For purposes of description relating to the figures, the terms "upper," "lower," "top," "bottom," "vertical," "horizontal," and derivatives thereof shall relate to the invention as oriented in FIG. 1 from the perspective of a consumer placing the lid onto a cup and drinking the contents of the cup through the lid. The terms "front" and "rear" refer to the side of the cup the consumer drinks from and the opposite side, respectively. However, it is to be understood that aspects of the present disclosure may assume various alternative orientations, except where expressly specified to the contrary.

Structure

FIGS. 1-6 illustrate an exemplary drink lid 10 according to an aspect of the present disclosure which is configured to be mounted to the open top of a cup (not shown) in a conventional manner, the details of which are not germane to the present disclosure. While FIGS. 1-6 illustrate aspects of the present disclosure in the context of a cup lid having a drink opening plug similar to that described in U.S. Pat. No. 8,631,957, entitled "Recloseable Lid with Closure Plug," issued Jan. 21, 2014, the contents of which are incorporated herein by reference in their entirety, aspects of the present disclosure are not limited to this particular style of recloseable lid and may be used with any other suitable style of drink lid. Additional, non-limiting examples of drink lids suitable according to the present disclosure are illustrated in FIGS. 13-20. As used herein, recloseable encompasses lids having a drink opening plug integrally formed with the lid or connected to the lid as well as lids in which the drink opening plug is separate from the lid.

Figure 2:
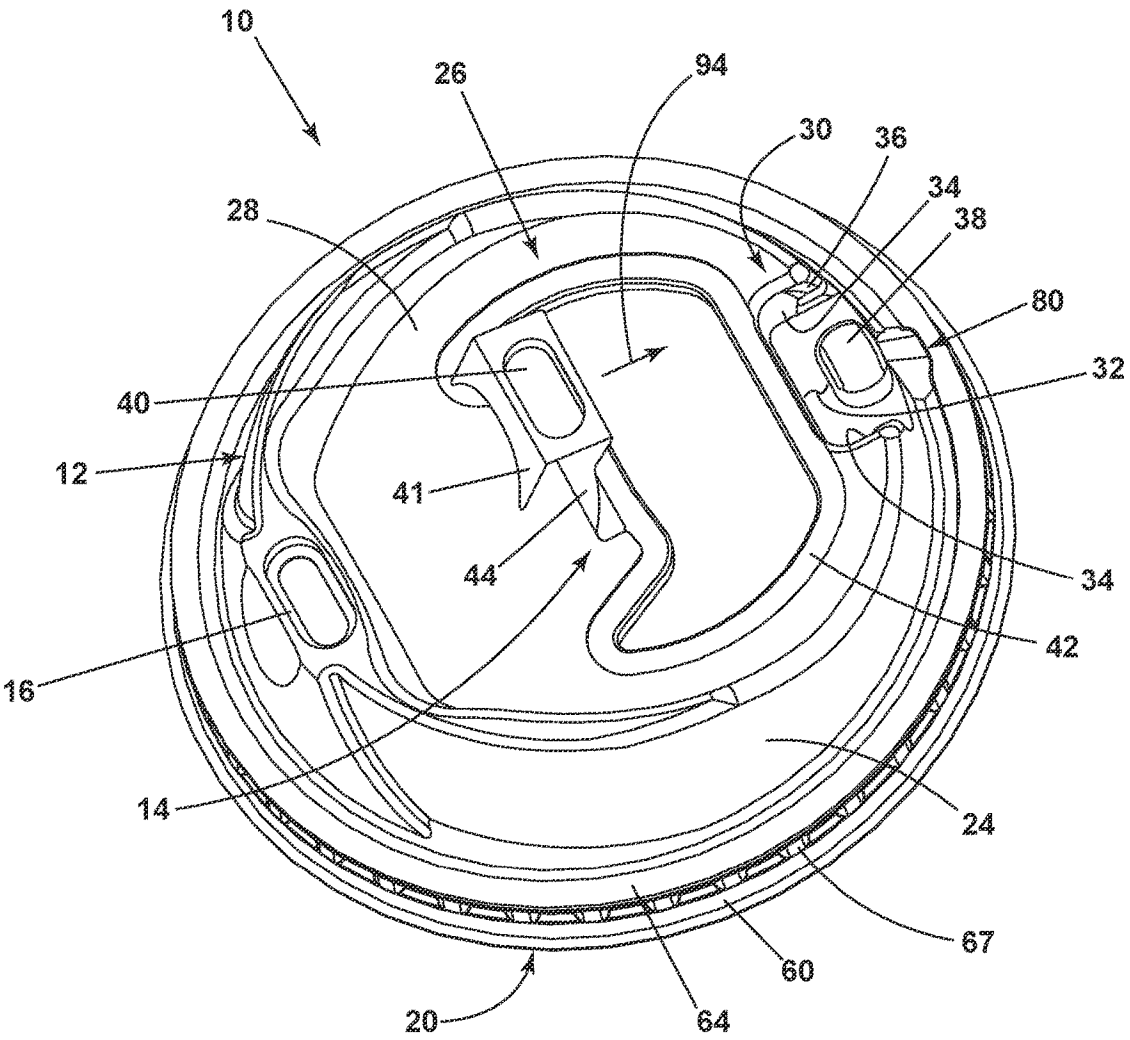
FIG. 2 is a perspective view of the recloseable lid of FIG. 1 illustrating the drink opening plug in an intermediary position between the closed position of FIG. 1 and the open position of FIG. 3 according to an aspect of the present disclosure.
Figure 3:
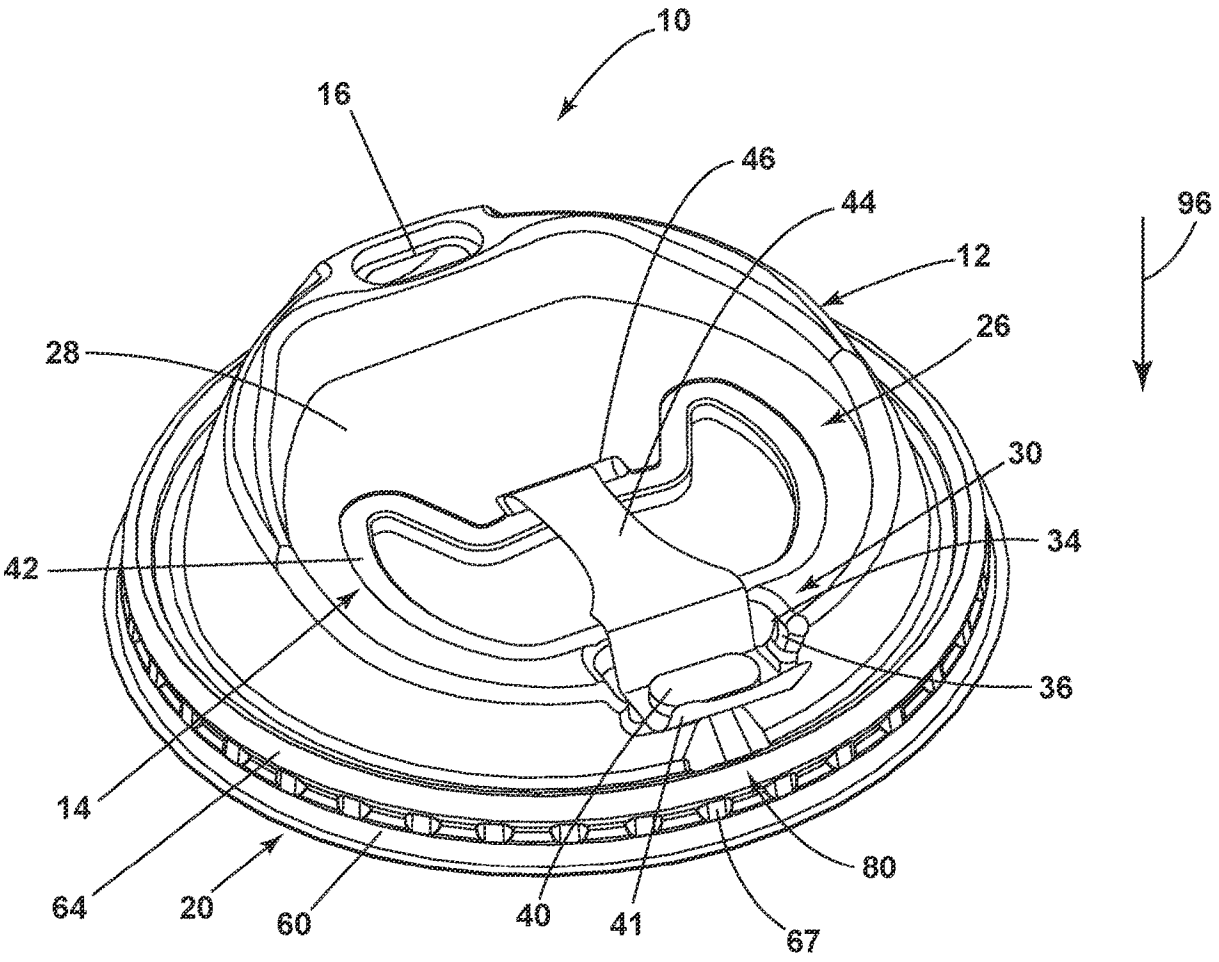
FIG. 3 is a perspective view of the recloseable lid of FIG. 1 illustrating the drink opening plug in the open position according to an aspect of the present disclosure.

Referring now to FIGS. 1-3, the lid 10 includes a cap 12 and a plug assembly 14 configured to selectively close a drink opening 16 (FIG. 2) formed in the lid 10. The plug assembly 14 is selectively moveable between a closed position, illustrated in FIG. 1, and an open position, illustrated in FIG. 3. The lid 10 includes a cup mount 20 configured to receive an upper edge of a cup for mounting the lid 10 to the cup (not shown).

The cap 12 can include an annular side wall 24 that extends upward from the cup mount 20 and terminates in a top 26 having an annular floor 28 spaced above the cup mount 20. The cap 12 includes a plug retainer 30 configured to retain the plug assembly 14 in the open position of FIG. 3. The plug retainer 30 includes a cavity 32 defined by a pair of opposing cavity side walls 34 each having a notch or undercut 36. The opposing cavity side walls 34 together define a width We of the cavity 32. Optionally, the plug retainer 30 includes a male connector 38 disposed within the cavity 32.

The plug assembly 14 includes a drink opening plug 40 configured to be received within the drink opening 16 when the plug assembly 14 is in the closed position of FIG. 1 to selectively close the drink opening 16. An optional tab 41 may be provided to facilitate grasping of the plug assembly 14 by a consumer during use. The plug assembly 14 includes a mounting plug 42 connected to the drink opening plug 40 by a strap 44. The strap 44 is connected with the mounting plug 42 by a hinge 46 such that the drink opening plug 40 can be moved between the closed position of FIG. 1 and the open position of FIG. 3 by rotating the strap 44 relative to the mounting plug 42 through the hinge 46.

Figure 4:
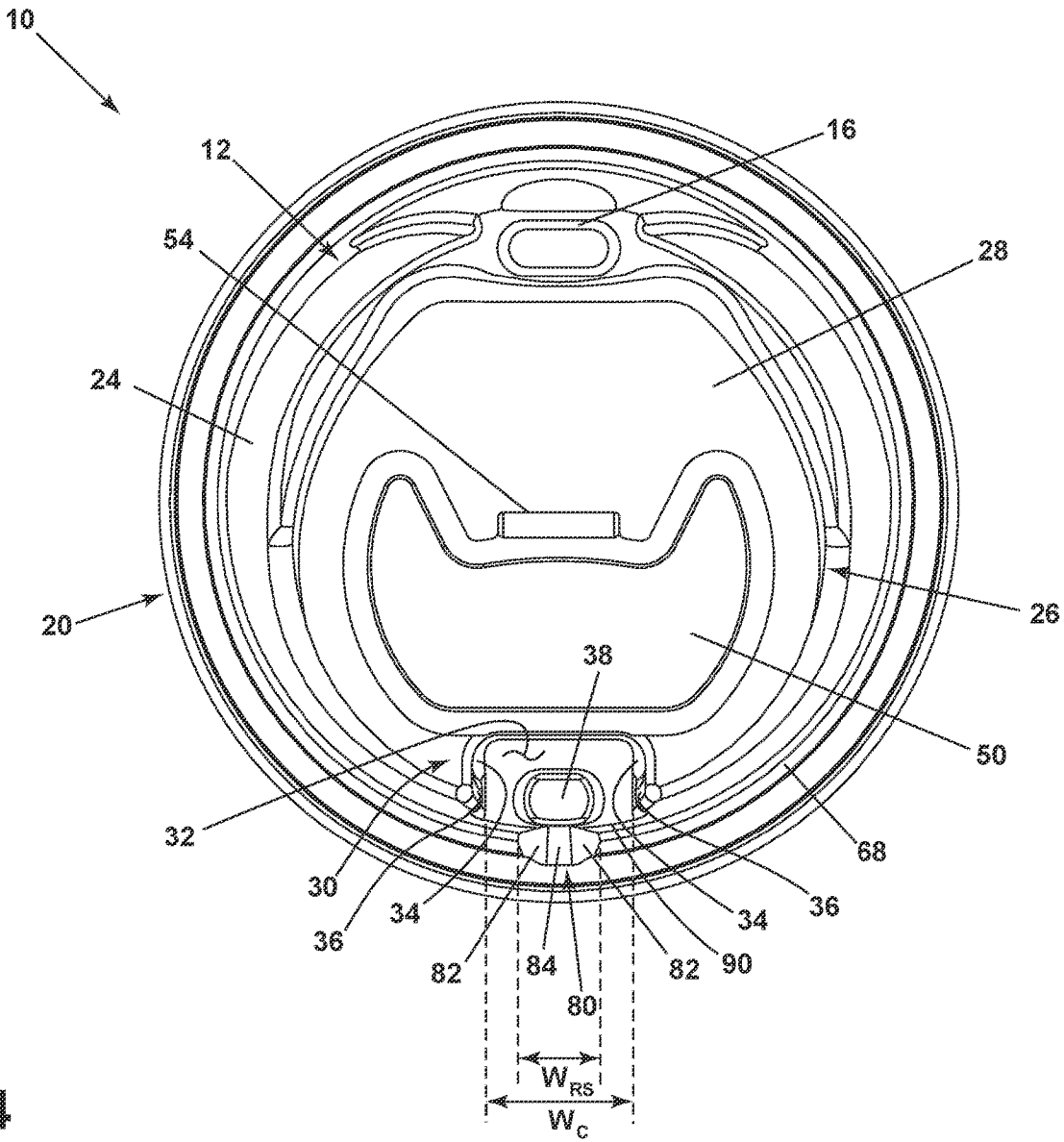
FIG. 4 is a top-down view of the recloseable lid of FIG. 1 with a portion removed for clarity according to an aspect of the present disclosure.
Figure 5:
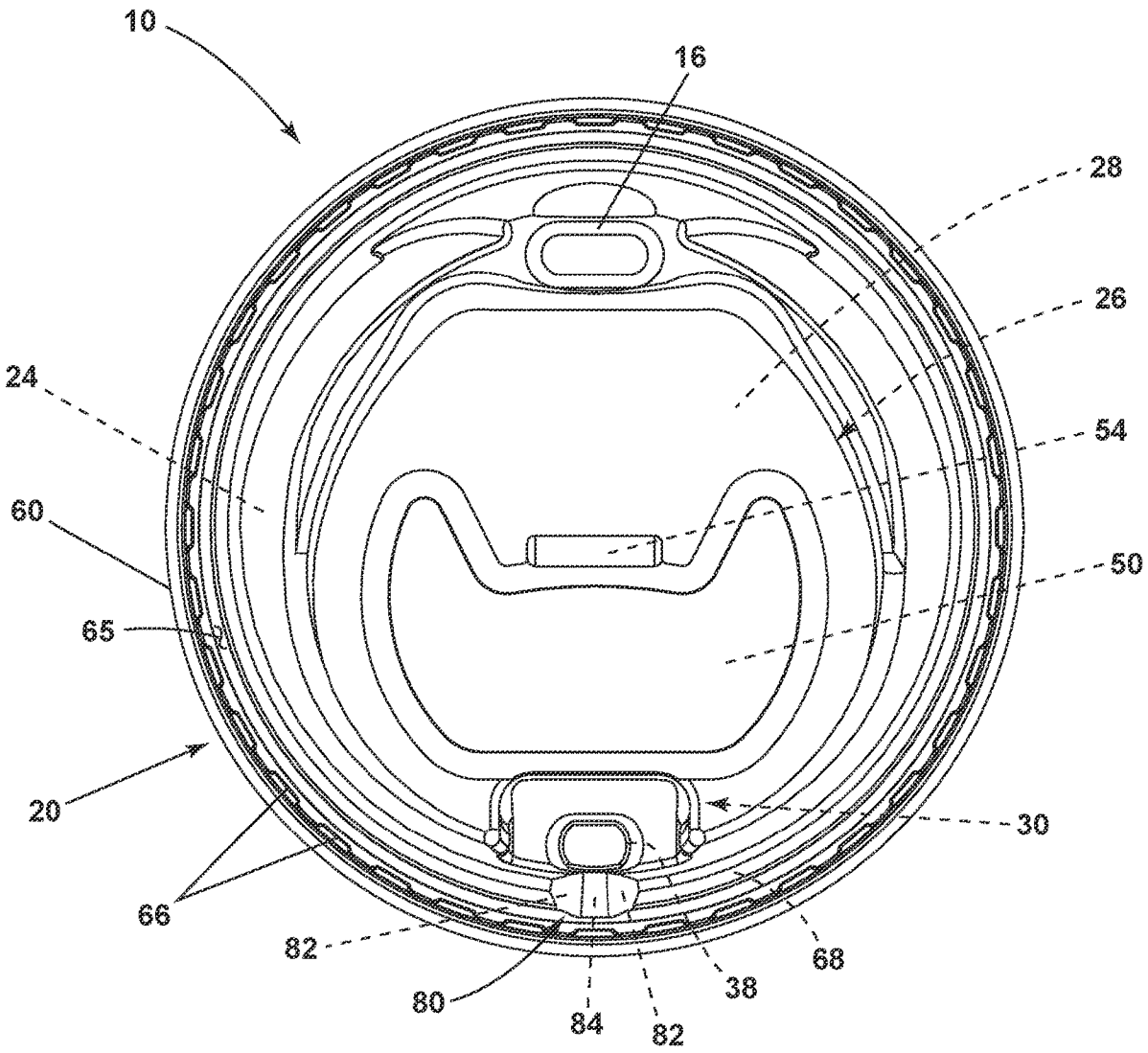
FIG. 5 is a bottom-up view of the recloseable lid of FIG. 1 according to an aspect of the present disclosure.
Figure 6:
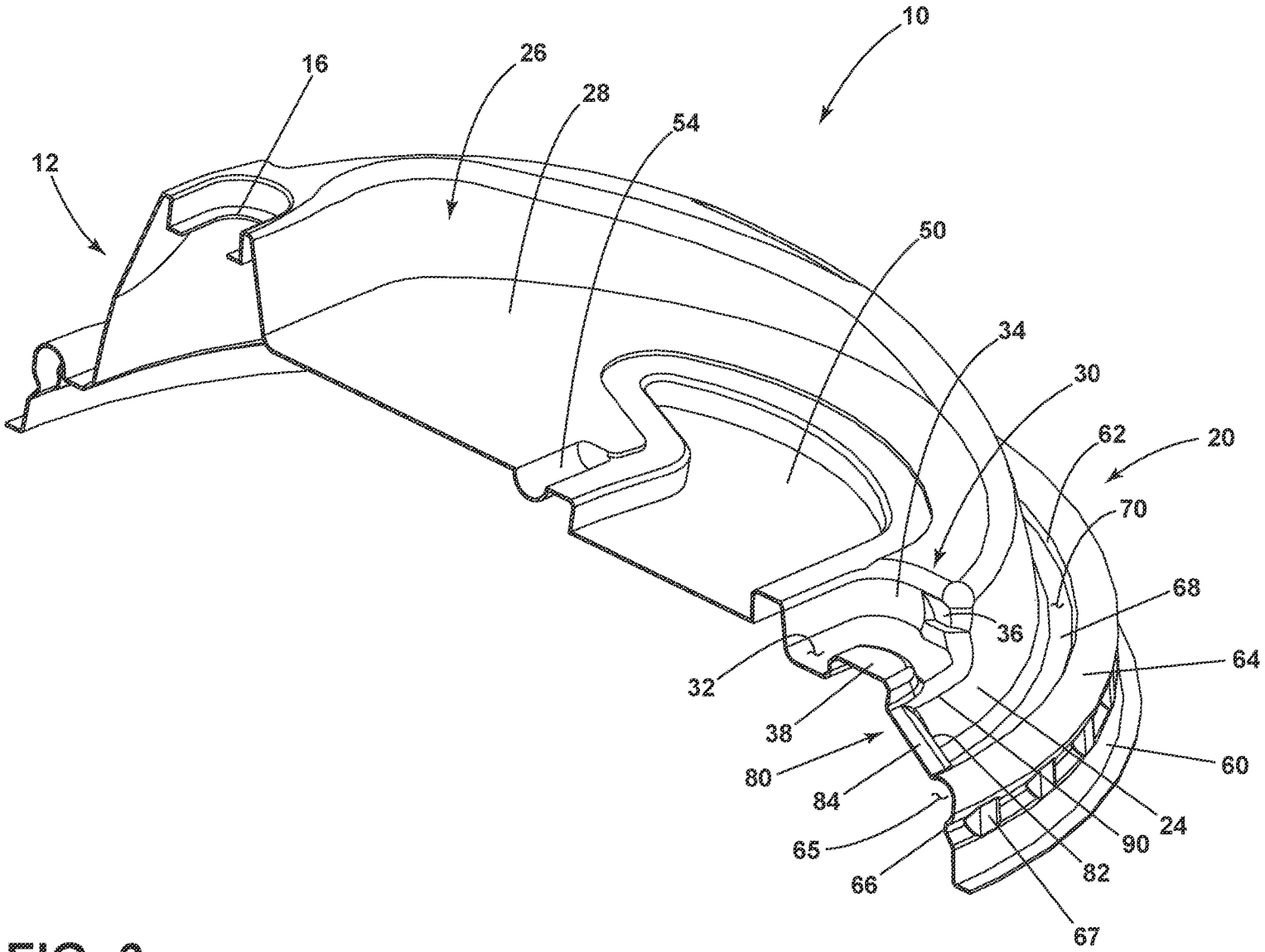
FIG. 6 is a cross-sectional view of the recloseable lid of FIG. 1 with a portion removed for clarity according to an aspect of the present disclosure.

Referring now to FIGS. 4-6, in which the plug assembly 14 is not shown, the top 26 includes a mounting cavity 50 having a shape that is configured to mate with the mounting plug 42 for coupling the plug assembly 14 with the lid 10. The mounting cavity 50 and mounting plug 42 can be configured to mate through any suitable type of connection, such as a snap-fit or interference fit type connection. While the mounting cavity 50 is illustrated as a cavity projecting downward from the floor 28, the mounting cavity 50 can optionally be configured to project upward from the floor 28 to form a male connector and the mounting plug 42 can be configured accordingly as a female connector to mate with the upward projection.

The top 26 can further include a hinge trough 54 formed in the floor 28 and configured to mate with the plug assembly hinge 46 through any suitable type of connection, such as a snap-fit or interference fit type connection. While the hinge trough 54 is illustrated as a cavity projecting downward from the floor 28, the hinge trough 54 can optionally be configured to project upward from the floor 28 to form a male connector and the hinge 46 can be configured accordingly as a female connector to mate with the upward projection.

Referring FIGS. 5-6, the cup mount 20 can include an annular skirt 60 connected to an annular inner wall 62 by a top wall 64 which together at least partially define a mounting recess 65 configured to receive the rim of a container for mounting the lid 10 to the cup. The top wall 64 may have a generally rounded or squared-off cross-sectional shape, as is known in the art. The annular skirt 60 can include a series of spaced ribs 66 that extend around the perimeter of the lid and project inward at least partially into the mounting recess 65 for gripping the upper edge of the cup. Each rib 66 can be separated from an adjacent rib 66 by a flute 67. The ribs 66 and flutes 67 can be consistently shaped and dimensioned around the periphery of the lid 10 or can vary. Optionally, the annular skirt 60 can include a single, uninterrupted annular rib that extends around the perimeter of the lid. Optionally, the annular inner wall 62 can include one or more ribs that projects inward for gripping the upper edge of the cup in combination with or as an alternative to the spaced ribs 66 or single, uninterrupted annular rib in the annular skirt 60. The annular inner wall 62 can optionally be spaced from the annular side wall 24 by an annular floor 68 which, together with the annular inner wall 62 and the annular side wall 24 define an annular channel 70.

Figure 21:
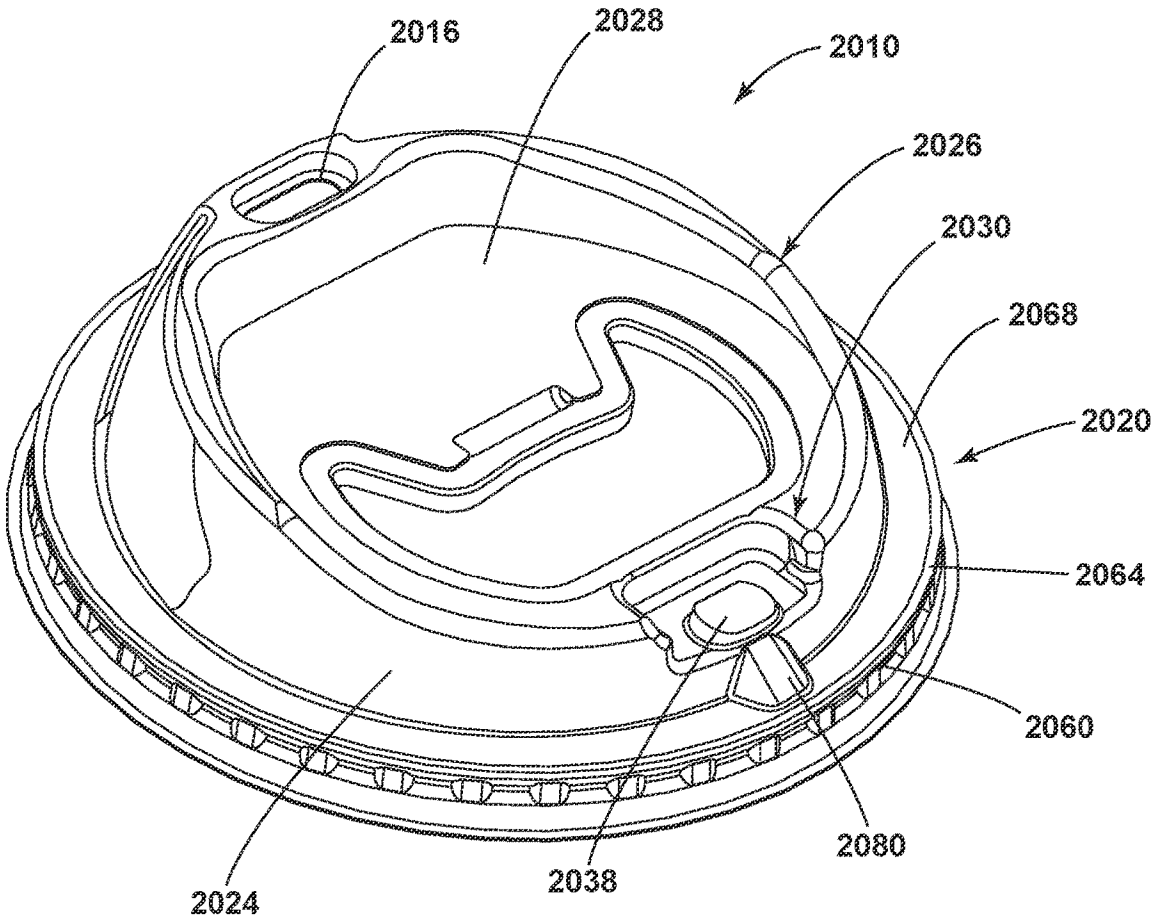
FIG. 21 is a perspective view of a recloseable lid having a reinforcement structure according to an aspect of the present disclosure.
Figure 22:
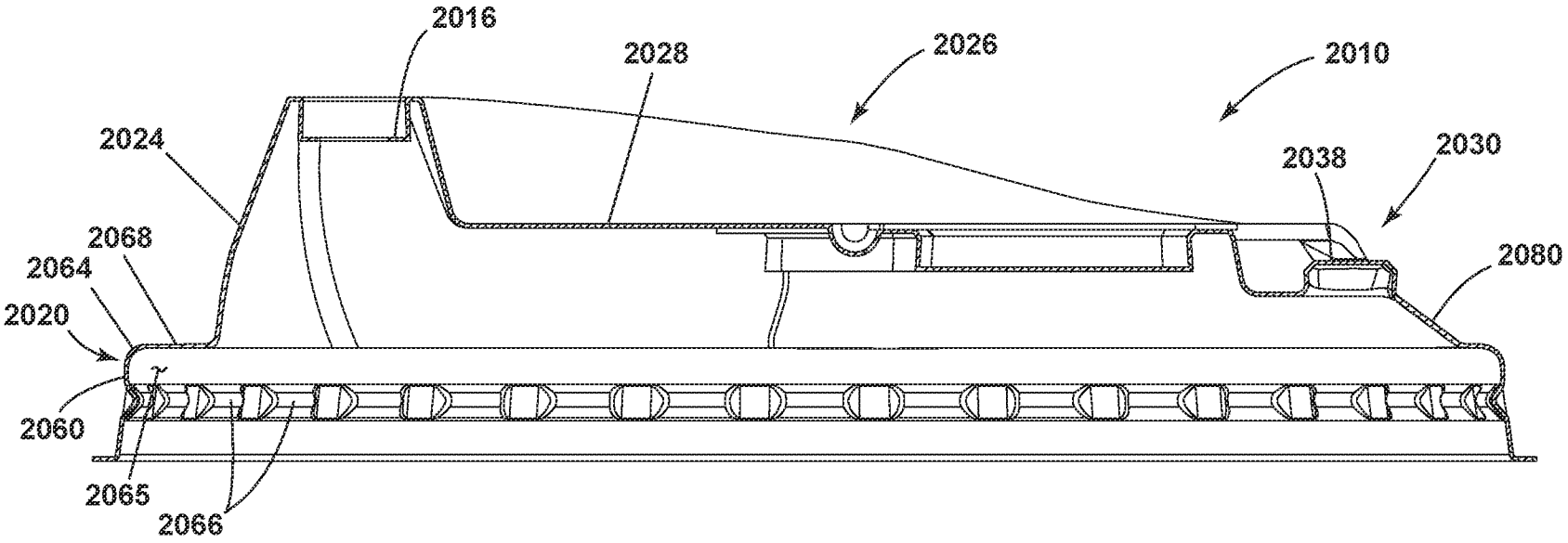
FIG. 22 is a cross-sectional view of the recloseable lid of FIG. 21 according to an aspect of the present disclosure.

The cup mount 20 can be configured to mount the lid 10 to a cup in any manner known in the art for mounting a lid to a container, optionally in a manner that provides a liquid tight seal. Examples of suitable lid mounting configurations include an interference fit and a plug fit. The term interference fit is used herein to refer to lids that include a securement feature (such as an inward directed rib or ribs 66, as one example) that applies a contact force to the cup that is directed radially inward toward the center of the cup when the cup rim is received within the annular mounting recess. Optionally, the lid includes a flexible skirt that allows the securement feature to expand as the cup rim is moved into the annular mounting recess, facilitating fitting the lid onto the cup. Optionally, the securement feature has a smaller diameter relative to the rim of the cup to increase the degree of interference, and thus the seal, between the securement feature and the cup. An example of an interference fit mounting configuration is illustrated in FIGS. 21-22.

The term plug fit is used herein to refer to a lid mounting configuration in which the lid includes a securement feature that applies a contact force to both the interior and exterior sides of the cup rim, thereby "pinching" the upper edge of the cup. An example of a plug fit mounting configuration can include an annular mounting recess that is configured to receive the cup rim therein and apply a contact force to both the interior and exterior sides of the cup. Portions of the lid forming the annular mounting recess can be shaped and dimensioned to provide the contact force on both the interior and exterior sides of the cup to pinch the cup therein, thereby securing the cup rim within the annular channel. FIGS. 1-6 illustrate an example of a plug fit lid configuration in which the annular inner wall 62 and top wall 64 are configured to apply a contact force to the cup rim in combination with the spaced ribs 66 which apply a radially inward directed contact force to thereby pinch the cup rim within the annular mounting recess 65. Still referring to FIGS. 4-6, the lid 10 includes a reinforcement structure 80 which facilitates engagement of the drink opening plug 40 with the plug retainer 30 when the drink opening plug 40 is secured in the open position of FIG. 3. The reinforcement structure 80 can be disposed adjacent to the plug retainer 30 and extend from the plug retainer 30 toward the cup mount 20. In the embodiment of FIGS. 1-6, the reinforcement structure 80 is in the form of a raised structure that connects the plug retainer 30 with the cup mount 20. The reinforcement structure 80 can extend across the entire distance between the plug retainer 30 and the cup mount 20, as illustrated in FIGS. 1-6. Optionally, the reinforcement structure 80 spans only a portion of the distance between the plug retainer 30 and the cup mount 20.

The reinforcement structure 80 can have the shape of a box girder which is open on the bottom, i.e., there is no bottom wall. The reinforcement structure 80 can be formed into the annular floor 68 and includes a pair of sidewalls 82 connected by a top wall 84. While the reinforcement structure is illustrated as having a generally trapezoidal cross-sectional shape, the reinforcement structure 80 can have any suitable cross-sectional shape, including rounded, squared, or rectangular. The reinforcement structure can be in the form of hollow or solid ridges, gussets, box girders, etc. configured to provide strength, support, and/or stiffness according to the present disclosure. The reinforcement structure 80 can be formed into the annular floor 68 or can be a separate structure disposed between the plug retainer 30 and the cup mount 20.

As illustrated in the embodiment of FIGS. 4-6, a portion of the plug retainer 30 is formed in the annular side wall 24 such that an exterior edge 90 of the plug retainer 30 is formed in the annular side wall 24. The reinforcement structure 80 can be configured to extend from the exterior edge 90 of the plug retainer 30 toward the cup mount 20. Optionally, the reinforcement structure 80 can be connected with a portion of the cap 12 adjacent the plug retainer 30, such as a portion of the annular side wall 24 adjacent to the plug retainer 30. For example, the reinforcement structure 80 can be configured to extend from the annular side wall 24 adjacent to, but below the exterior edge 90 of the plug retainer 30 and/or one or both cavity side walls 34. The reinforcement structure 80 can have a width $W_{RS}$ that is less than the width $W_C$ of the cavity 32 defined by the cavity side walls 34. Optionally, the reinforcement structure 80 can have a width $W_{RS}$ that is equal to or greater than the width $W_C$ of the cavity 32.

Materials

The lid 10 can be made from any polymeric composition suitable for thermoforming. The lid composition can include one or more polymers, non-limiting examples of which include polystyrene, polypropylene, polyethylene, and polylactic acid. The lid composition can also include additives known in the art for use in thermoformed lid compositions, non-limiting examples of which include fillers, colorants, flow additives, slip agents, and other processing aids. Examples of suitable fillers include talc, mica, calcium carbonate, wollastonite, paper powder, cellulose, wood fiber, and combinations thereof. In one aspect of the present disclosure, the lid 10 is made from a polymeric composition that is free of polystyrene.

As used herein, the terms polypropylene, polypropylene-based, and propylene-based are used interchangeably to refer to any polymeric material including blocks, chains, and/or branches based on the monomer unit propylene and includes both homopolymers and copolymers, unless otherwise specified. As used herein, the terms polyethylene, polyethylene-based, and ethylene-based are used interchangeably to refer to any polymeric material including blocks, chains, and/or branches based on the monomer unit ethylene and includes both homopolymers and copolymers, unless otherwise specified. As used herein, the terms polylactic acid, polylactic acid-based, and lactic acid-based are used interchangeably to refer to any polymeric material including blocks, chains, and/or branches based on the monomer unit lactic acid and includes both homopolymers and copolymers, unless otherwise specified. As used herein, the terms polystyrene, polystyrene-based, and styrene-based are used interchangeably to refer to any polymeric material including blocks, chains, and/or branches based on the monomer unit styrene and includes both homopolymers and copolymers, unless otherwise specified.

(a) Polyolefin-Based Compositions

According to one aspect of the present disclosure, the lid 10 can be formed from a polyolefin-based composition, optionally a polyolefin-based composition that produces a lid having a density less than 1 g/cm$^3$ at 23° C. A density less than 1 g/cm$^3$ at 23° C. may be desirable in order to produce a lid that is recyclable using conventional practices that rely on capturing recyclable material floating in a recycling stream. One example of a suitable polyolefin-based composition for forming the lid 10 is disclosed in co-pending application, U.S. Provisional Patent Application No. 62/570,222, filed Oct. 10, 2017, entitled "Polyolefin-Based Composition for a Lid and Methods of Making and Using," the contents of which are herein incorporated by reference in their entirety. The lid 10 can be made from a polyolefin composition that includes at least one polyolefin and at least one filler.

Non-limiting examples of suitable polyolefins include polypropylene homopolymer, polypropylene impact copolymers, ethylene-propylene copolymers, high density polyethylene, polyethylene homopolymers, and combinations thereof. Copolymers of polypropylene can include copolymers in which the polymer is derived from polypropylene monomers and at least one other species of monomer or a block copolymer derived from blocks of polypropylene monomers and blocks derived from at least one other species of monomer, non-limiting examples of which include ethylene, propylene, or a combination of ethylene and propylene.

According to one aspect of the present disclosure, the polyolefin includes a polypropylene that is a high modulus polypropylene homopolymer having a flexural modulus of at least about 290,000 psi, optionally at least about 300,000 psi, as measured according to ASTM D-790A. Optionally, the polyolefin is a high crystalline polypropylene characterized by low xylene solubles (XS), which is generally considered to be related to isotacticity and crystallinity. When compared to standard homopolymer resins, high crystalline polypropylene exhibits a higher stiffness and increased chemical and heat resistance. In one aspect, the polyolefin is a high crystalline polypropylene having a flexural modulus of at least about 290,000 psi, optionally at least about 300,000 psi, and further optionally about 290,000 to 300,000 psi, as measured according to ASTM D-790A. In another aspect, polypropylenes having an HDT of at least about 95° C., optionally at least about 105° C., further optionally at least about 115° C. at 66 psi, as measured according to ASTM D648, may be used.

According to another aspect, preferred polypropylenes have a modulus of elasticity, as measured by Dynamic Mechanical Analysis (DMA), of at least about 160,000 psi, optionally at least about 210,000 psi, further optionally at least about 230,000 psi at temperatures corresponding to hot drink temperatures according to ASTM D4065 and ASTM E2254-03. An example of a hot drink temperature includes 90° C.

In one aspect of the present disclosure, the polyolefin includes at least one polypropylene having a flexural modulus of at least about 290,000 psi, optionally at least about 300,000 psi, an HDT of at least about 95° C., optionally at least about 105° C., further optionally at least about 115° C., and/or a modulus of elasticity of at least about 160,000 psi, optionally at least about 210,000 psi, further optionally at least about 230,000 psi.

The filler can be a mineral filler, a natural fiber-based filler, or combinations thereof. Non-limiting examples of suitable mineral fillers include talc, calcium carbonate, mica, wollastonite, and combinations thereof. Non-limiting examples of suitable natural fiber-based fillers include wood fiber, paper powder, cellulose fiber, and combinations thereof. Optional additives for use with the polyolefin composition include colorants and processing aids.

The thickness of the extruded sheet, when used for forming lids, can be about 0.035 inches or less, optionally about 0.025 inches or less. The thickness of the lid formed from the extruded sheet can vary depending on the lid design, but can be less than about 0.01 inches, optionally less than about 0.015 inches, further optionally less than about 0.025 inches, still further optionally less than about 0.035 inches, and further optionally within the range of about 0.015 to 0.018 inches.

Optionally, the polyolefin composition is treated such that the sheet formed using the polyolefin composition has an expanded cellular structure formed therein to decrease the density of the extruded polyolefin-based sheet compared to a similar polyolefin-based sheet that has not been treated, as described in co-pending application U.S. Provisional Patent Application No. 62/570,222, filed Oct. 10, 2017, entitled "Polyolefin-Based Composition for a Lid and Methods of Making and Using." According to one aspect of the present disclosure, treatment of the polyolefin composition to decrease the density of the extruded sheet includes adding a chemical blowing agent to the extrusion blend. According to another aspect, treatment to decrease the density includes a method of extruding the polyolefin composition to induce the formation of an expanded cellular structure within the extruded sheet.

When present, the amount and type of blowing agent can be selected to decrease the density of the extruded sheet such that a lid formed from the sheet has a density less than 1 g/cm$^3$ at 23° C. Unless otherwise stated, densities are given at 23° C. and atmospheric pressure. Having a density less than 1 g/cm$^3$ allows the lid to float on water, thus facilitating recycling of the lid material using processes that rely on the material to be recycled floating at or near the surface of the recycling stream. Optionally, the material can also be defined in terms of its specific gravity relative to water. The lid can be formed to have a specific gravity less than 1, relative to water at 23° C. and atmospheric pressure, such that the lid floats in water.

The chemical blowing agent can be selected from any chemical blowing agent compatible with the polyolefin(s) present in the polyolefin-based composition. The chemical blowing agent introduces gas (e.g., carbon dioxide, nitrogen, steam) into the resin mixture to form an expanded cellular structure within the resin and reduce the density of the extrudate. Chemical blowing agents can be organic or inorganic materials that release gas upon thermal decomposition. Expansion of the cells in the resin mixture can occur during and/or after extrusion. Non-limiting examples of suitable chemical blowing agents include sodium bicarbonate, sodium carbonate, ammonium bicarbonate, ammonium carbonate, and ammonium nitrite. According to one aspect, the chemical blowing agent can be present in an amount of about 0.5-3 wt. %, optionally about 0.5-2 wt. %, further optionally about 1-3 wt. %.

According to another aspect, the extrusion process of the polyolefin blend can be controlled to induce the formation of an expanded cellular structure within the extruded sheet in the absence of a chemical blowing agent, as described in co-pending application U.S. Provisional Patent Application No. 62/570,222, filed Oct. 10, 2017, entitled "Polyolefin-Based Composition for a Lid and Methods of Making and Using." The polyolefin-blend can be extruded without venting or degassing to induce the formation of cells within the material. Without being limited to a particular theory, it is theorized that the absence of venting or degassing during extrusion results in moisture present in the blend being converted to steam which can create cells in the extrudate as the steam travels through the material, thus forming the expanded cellular structure. Mineral fillers present in the blend, such as talc, can act as nucleating agents to facilitate the formation of cells within the extrudate.

In an exemplary embodiment, the polyolefin blend can be extruded through a rotary extruder having a single stage screw with no venting or degassing. The polyolefin blend can optionally include about 30-50% of a polyolefin regrind that includes a polyolefin and a mineral filler, such as talc. It is theorized that the regrind may have a higher moisture content than virgin polypropylene and thus may facilitate formation of the cells during extrusion without venting/degassing. The polyolefin regrind can be recycled trimmed material and/or recycled waste lids that is ground for inclusion in the polyolefin extrusion blend.

(b) Multi-Layer Sheet

According to one aspect of the present disclosure, the lid 10 can be formed from a multi-layer sheet including a substrate layer including a first polyolefin-based composition and a cap layer including a second polyolefin-based composition. An example of a suitable multi-layer sheet is described in co-pending application U.S. Provisional Patent Application No. 62/638,424, filed Mar. 5, 2018, entitled "Polyolefin-Based Composition for a Lid and Methods of Making and Using," which is incorporated herein by reference in its entirety.

The substrate composition forming the substrate layer can include a polyolefin-based composition that includes at least a primary polyolefin material and at least one filler, and optionally other additives, which can be combined to form a blend suitable for extrusion through a die. The cap composition forming the cap layer can include a polyolefin-based composition that includes a polyethylene-based material in combination with at least one polypropylene-based material and at least one filler, and optionally other additives, which can be combined to form a blend suitable for co-extrusion with the substrate composition. Optionally, one or both of the substrate and cap compositions can include a secondary, tertiary, or any additional number of polyolefin-based materials. As used herein, the primary polyolefin material is defined as the polyolefin or blend of polyolefins that forms the majority of the composition. Secondary, tertiary, etc. polyolefin materials, when present, are present in an amount equal to or less than the primary polyolefin material.

Non-limiting examples of suitable primary polyolefin materials for use in the substrate composition forming the substrate layer include polypropylene homopolymers, polypropylene copolymers, and combinations thereof. Copolymers of polypropylene for use in the substrate composition can include copolymers in which the polymer is derived from propylene monomers and at least one other propylene monomer or a block copolymer derived from blocks of propylene monomers and blocks derived from at least one other propylene. The polypropylene can be linear or branched. Optionally, additional polypropylene homopolymers and/or polypropylene copolymers may be present as secondary or tertiary polyolefin materials.

According to one aspect of the present disclosure, the primary polyolefin material of the substrate composition includes a polypropylene that is a high modulus polypropylene homopolymer having a flexural modulus of at least about 290,000 psi, optionally at least about 300,000 psi, as measured according to ASTM D-790A. Optionally, the primary polyolefin is a high crystalline polypropylene characterized by low xylene solubles (XS), which is generally considered to be related to isotacticity and crystallinity. Optionally, the primary polyolefin is a high crystalline polypropylene characterized by a crystallinity of about 52.5% or greater and having a crystallization peak temperature above 132° C. When compared to standard homopolymer resins, high crystalline polypropylene exhibits a higher stiffness and increased chemical and heat resistance. In one aspect, the polyolefin is a high crystalline polypropylene having a flexural modulus of at least about 290,000 psi, optionally at least about 300,000 psi, and further optionally about 290,000 to 300,000 psi, as measured according to ASTM D-790A. In another aspect, polypropylenes having an HDT of at least about 95° C., optionally at least about 105° C., further optionally at least about 115° C. at 66 psi, as measured according to ASTM D648, may be used. An example of a commercially available polyolefin suitable from the substrate composition includes Inspire® 6025N from Braskem, U.S.A. The polypropylene can be present in the substrate composition in a range of about 80 to 90 percent by (wt. %) of the substrate composition.

In one aspect of the present disclosure, the primary polyolefin material of the substrate composition includes at least one polypropylene having a flexural modulus of at least about 290,000 psi, optionally at least about 300,000 psi, an HDT of at least about 95° C., optionally at least about 105° C., further optionally at least about 115° C., and/or a modulus of elasticity of at least about 160,000 psi, optionally at least about 210,000 psi, further optionally at least about 230,000 psi.

Non-limiting examples of suitable polyethylene-based material for use in the cap composition forming the cap layer include ethylene-propylene copolymers, polyethylene homopolymers and copolymers, high density polyethylene, or combinations thereof. The polypropylene in the cap composition can be the same or different than the primary polypropylene in the substrate composition. The polyethylene-based material can be present in the cap composition in an amount equal to, less than, or greater than the polypropylene. The polyethylene-based material and the polypropylene can be pre-blended and combined with the remaining materials of the cap composition or provided separately to the mixture of materials forming the cap composition and blended. The blend of polyethylene-based material and polypropylene can be present in the cap composition in a range of about 65 to 80 wt. % of the cap composition. Optionally, the cap composition can include one or more additional polypropylenes (e.g., secondary, tertiary, etc.).

An example of a suitable commercially available blend of a polyethylene-based material and polypropylene for use in the cap composition is Polybatch® DUL3636 from Schulman, which is described as a blend of polypropylene and polyethylene. According to one aspect of the present disclosure, the polypropylene/polyethylene blend has a melt tangent delta at 230° C. in the range of about 1-2.5. According to one aspect of the present disclosure, the polypropylene/polyethylene blend has a melt complex viscosity at 230° C. in the range of about 6000-7500 Pa·sec. In one aspect, the polypropylene/polyethylene blend has a melt tangent delta at 230° C. in the range of about 1-2.5 in combination with a melt complex viscosity at 230° C. in the range of about 6000-7500 Pa·sec.

The melt tangent delta is the tangent of the phase angle (the delay between the applied force and material response) and is the ratio of loss to elasticity, sometimes also referred to as damping. Unless otherwise specified, as used herein, the melt tangent delta, is measured by dynamic mechanical analysis using a parallel plate rheometer at 230° C., 1% strain rate, and 0.1 rad/s frequency according to ASTM D4440-2015 or ISO 6721. Unless otherwise specified, the melt complex viscosity, as used herein, is measured by dynamic mechanical analysis using a parallel plate rheometer at 230° C., 1% strain rate, and 0.1 rad/s frequency according to ASTM D4440-2015 or ISO 6721.

The filler in the substrate layer and the cap layer can be the same or different. Non-limiting examples of suitable fillers include talc, mica, calcium carbonate, and combinations thereof. According to one aspect of the present disclosure, the same type of filler can be used in both the substrate composition and the cap composition, but at least one characteristic of the filler is different between the substrate composition and the cap composition. Examples of filler characteristics include filler particle size (e.g., diameter), shape, or aspect ratio. For example, the substrate composition can include a talc filler having an average particle size, as defined by particle diameter, for example, which is different than an average particle diameter of a talc filler present in the cap composition.

In one aspect of the present disclosure, the filler is added to the substrate composition and the cap composition as a filler masterbatch that includes the filler in a polyolefin-based carrier, such as polypropylene. The amount of filler masterbatch added to each of the substrate and cap compositions can be selected to provide a desired amount of filler in the formed substrate and cap layers, respectively. The ratio of filler to carrier in a given masterbatch can be used to determine the amount of filler masterbatch to add to provide the desired amount of filler.

For example, commercially available filler masterbatches suitable for the present disclosure generally include about 40 to 60 wt. % of filler. One example of a suitable commercially available filler masterbatch is HT6HP from Heritage Plastics, which is described as 60% talc in a polypropylene homopolymer filler. Another example of a suitable commercially available filler masterbatch is SUKANO® p-ma-218 from Sukano Polymers Corporation, U.S.A., which is described as a talc filler in a polypropylene homopolymer filler. When a filler masterbatch is used, the carrier can be considered as an additional polyolefin in the composition (e.g., secondary, tertiary, etc. as the case may be).

The amount and type of filler present in the substrate and cap compositions can be selected to provide the multi-layer sheet and the lid 10 formed from the multi-layer sheet with the desired characteristics. In one aspect, the type and amount of filler present in each of the substrate and cap compositions is selected to provide the lid 10 with a density less than 1 g/cm$^3$ at 23° C.

In another aspect, the type and amount of filler present in the cap composition is selected to provide the cap layer with a matte finish having a gloss level of about 6 gloss units or less. The gloss level referred to herein was determined using a gloss meter at a 60 degree measurement angle. The gloss meter was used to take a gloss level measurement at multiple locations of the test sample and the highest reading was recorded. The measurement values for the gloss meter are related to the amount of reflected light from a calibration standard for defining a standard gloss unit according the instructions provided by the manufacturer of the gloss meter, as is known in the art.

In one aspect of the present disclosure, the amount of filler present in the substrate and cap compositions is selected to provide the multi-layer sheet with a total filler content of about 12 wt. % or less based on the weight of the multi-layer sheet such that the lid 10 has a density less than 1 g/cm$^3$ at 23° C. In one example, the substrate and cap compositions include about 15 to 30 wt. % of a filler masterbatch that includes about 40 to 60 wt. % of the filler in a polyolefin-based carrier. The filler masterbatch can be the same or different in the substrate and cap compositions.

In one aspect of the present disclosure, the substrate composition includes a filler masterbatch and the cap composition includes a different filler masterbatch having particles with an average diameter that is greater than the filler particles in the substrate composition. In this example, the substrate composition includes about 15 to 20 wt. % of the filler masterbatch and the cap composition includes about 20 to 30 wt. % of the filler masterbatch.

The substrate and cap compositions can optionally include additives to provide the lid 10 with the desired characteristics, examples of which include colorants and processing aids. The additives in the substrate and cap compositions can be the same or different. In one aspect of the present disclosure, the substrate and cap compositions include a colorant, an example of which includes titanium dioxide. One example of a suitable commercially available colorant is Standridge blue white concentrate (blue white) which includes titanium dioxide and optionally calcium carbonate. Another example is Ferro CH27043 2FDA from Ferro Corporation, U.S.A. The colorant can be provided in one or both of the substrate and cap layers in an amount suitable to provide the lid with the desired appearance. In one example, the colorant is present in one or both of the substrate and cap layers in a range of about 1-4 wt. %, optionally about 2-3 wt. %.

The total thickness of the multi-layer sheet (i.e., the thickness of the substrate layer plus the thickness of the cap layer), when used for forming lids, can be about 0.035 inches or less, optionally about 0.025 inches or less. The thickness of the lid formed from the multi-layer sheet can vary depending on the lid design, but can be less than about 0.01 inches, optionally less than about 0.015 inches, further optionally less than about 0.025 inches, still further optionally less than about 0.035 inches, and further optionally within the range of about 0.015 to 0.020 inches. In one aspect of the present disclosure, the cap layer forms about 10 to 20 percent of the total thickness of the multi-layer sheet. For example, the multi-layer sheet can have a total thickness of about 0.018 to 0.19 inches, including a cap layer having a thickness of about 0.002 to 0.003 inches.

(c) Polylactic Acid

According to one aspect of the present disclosure, the lid 10 can formed from a polylactic acid-based composition. The polylactic-acid based composition can include additives known in the art for use in thermoformed lid compositions, non-limiting examples of which include fillers, colorants, flow additives, slip agents, and other processing aids. Optionally, the polylactic-acid can be combined with one or more additional polymers, non-limiting examples of which include polypropylene and polyethylene. The polylactic acid can be synthetic or derived from a natural material, such as corn starch, for example. Optionally, the polylactic acid-based composition includes virgin polylactic acid, polylactic acid regrind, or combinations thereof.

According to one aspect, polylactic acid can be substituted for one or more of the polyolefins of the polyolefin-based compositions described above.

(d) Polystyrene

In one aspect of the present disclosure, the lid 10 can be formed from a polystyrene-based composition. The polystyrene-based composition can include additives known in the art for use in thermoformed lid compositions, non-limiting examples of which include fillers, colorants, flow additives, slip agents, and other processing aids. Optionally, the polystyrene can be combined with one or more additional polymers, non-limiting examples of which include polypropylene and polyethylene. According to one aspect, the polystyrene-based composition includes high impact polystyrene (HIPS).

The polymeric compositions described herein can include at least one polymeric material and one or more additives which can be combined to form a blend suitable for extrusion through a die to form a polymeric sheet. Extrusion refers to a process for shaping or forming an article by moving material through a die opening by forcing, pressing, and/or pushing the material through the die opening. The die opening can be an orifice having any desired shape, such as a slit. The polymeric blend can be extruded through the die into a sheet or a cylinder that is subsequently cut to form a sheet for shaping into a lid. Extrusion can be performed continuously to form a long sheet or cylinder or can be semi-continuous such that multiple shorter segments are produced for later shaping into a lid. The lid production process may include in-line extrusion thermoforming or off-line extrusion thermoforming. Extrusion can be performed using a single screw extruder or a twin screw extruder, although the present disclosure is not limited to any particular extrusion device or die.

In one aspect of the present disclosure, thermoforming is performed on the exiting the extruder while the materials is still in molten/heated form from the extrusion process. In another aspect, the extruded sheets can be allowed to cool to room temperature and solidify following extrusion. The solidified sheets can then be reheated for forming using a reciprocating former, for example.

The extruded polymeric sheet according to any of the compositions described herein can be formed into a lid having the desired shape and dimensions by thermoforming. Non-limiting examples of thermoforming can include vacuum molding, pressure molding, plug-assist molding, and vacuum snapback molding. The thermoforming process can include heating the polymeric sheet (also referred to as a web) to a melting or softening temperature and then stretching or drawing the sheet over a mold. The web can be stretched or drawn over the mold while the web is still in a soft or molten state from the extrusion process without the application of heat from a heating unit. Optionally, the thermoforming process includes a heating unit, such as an oven, to reheat the web to a molten or soft state suitable for thermoforming. The material can be maintained over the mold as the material cools and solidifies to form the article. The formed article can then be trimmed from the thermoformed sheet and removed from the mold to form the lid. Optionally, the trimmed material is reground and processed for further use as regrind, alone or in combination with virgin polymeric material.

The extruded sheet can be fed from the extruder to a molding station where the thermoforming takes place or stored for further processing. In one example, the sheet is fed from the extruder to the molding station prior to the sheet cooling to room temperature and additional heat is optionally supplied to the sheet prior to forming the sheet around the mold. When the extruded sheet is stored prior to molding, heat is supplied to the sheet prior to forming the sheet around the mold. Heat for facilitating molding of the sheet during thermoforming can be supplied in any suitable manner, examples of which include radiant heat and heated air. Optionally, the thermoforming process includes blowing air onto the sheet to facilitating pressing the sheet about the mold. In another example, the thermoforming process can include vacuum molding in which the sheet is forced against the mold by a vacuum. Thermoforming can include a solid-phase forming process (e.g. using a reciprocating former) or a melt-phase forming process.

EXAMPLES

Example 1: Polypropylene and about 18-19 wt. % of talc masterbatch (talc combined with a polypropylene carrier) as a mineral filler. The measured talc content in lid 100 and 120 was 13.1% and 11.8%, respectively, as determined using Thermal Gravimetric Analysis (TGA) according to ASTM E1131 at 10° C./min.

Example 2: Same as Example 1 except for the inclusion of about 1.5 to 2.5 wt. % Hydrocerol 1499 from Clariant™, U.S.A. as a chemical blowing agent. The resultant cup lid had a density of about 0.95-0.96 g/cm$^3$, as measured according to ASTM D-792.

Example 3: A polypropylene homopolymer commercially available as Inspire® 6025N from Braskem, U.S.A. and 8-20 wt. % of a talc filler. An example talc filler is HT6HP from Heritage Plastics, which is described as 60% talc concentrated in a polypropylene homopolymer (masterbatch). 17-40 wt. % of HT6HP talc masterbatch results in a total talc content in the range of about 8-20 wt. % as determined by Thermal Gravimetric Analysis (TGA) and Ash Content. TGA was conducted according to ASTM E1131 at 10° C./min. Ash Content was conducted according to ASTM D3174. The composition can be extruded through a single stage screw rotary extruder with no venting or degassing to form a sheet having a density less than 1 g/cm$^3$.

Example 4: Same as Example 3 except that composition is extruded through a single stage screw rotary extruder with venting to form a sheet having a density greater than 1 g/cm$^3$.

Example 5: A polyolefin blend including a polypropylene homopolymer commercially available as Inspire® 6025N from Braskem, U.S.A., 25 wt. % of HT6HP talc masterbatch from Heritage Plastics, and about 1.5-2.5 wt. % Hydrocerol 1499 masterbatch from Clariant™, U.S.A. as a chemical blowing agent. The composition also includes 3 wt. % titanium dioxide as a colorant, an example of which is commercially available as CH27043 2FA masterbatch from Ferro Corporation, U.S.A. The density of lids formed using this composition was about 0.93 g/cm$^3$, as determined according to ASTM D-792.

Example 6: A multi-layer sheet was made by co-extruding a substrate composition and a cap composition through an extruder according to a conventional extrusion process and the extruded sheet was thermoformed to form a lid. The substrate composition includes 81.33 wt. % Inspire® 6025N from Braskem, 16.67 wt. % HT6HP talc masterbatch from Heritage Plastics, and 2 wt. % Standridge blue white concentrate. The cap composition includes 72 wt. % Polybatch® DUL3636 polyethylene/polypropylene blend from Schulman, 25 wt. % SUKANO® p-ma-218 talc masterbatch from Sukano Polymers Corporation, and 3 wt. % Standridge white concentrate. The cap composition provides the exterior of the formed lid with a gloss level of less than 6 gloss units. The formed lids have a density in the range of about 0.98 to 0.999 g/cm$^3$.

Example 7: A single layer of a polypropylene-based composition including 80.33 wt. % Inspire® 6025N from Braskem, 16.67 wt. % HT6HP talc masterbatch from Heritage Plastics, and 3 wt. % CH27043 2FDA from Ferro Corporation, U.S.A. was extruded and thermoformed to form a lid. The formed lid had a gloss level of about 20 to 25 gloss units. The formed lids have a density in the range of about 0.98 to 0.999 g/cm$^3$.

Operation

Referring again to FIGS. 1-3, when a consumer wishes to move the plug assembly 14 from the closed position of FIG. 1 to the open position of FIG. 3, the consumer can grasp the tab 41 and lift upward, as illustrated by arrow 92, to unseat the drink opening plug 40 from the drink opening 16. The drink opening plug 40 is moved across the lid 10 in the direction of arrow 94 in FIG. 2 toward the plug retainer 30 and pivoted about the hinge 46. The drink opening plug 40 can then be pressed downward in the direction of arrow 96 of FIG. 3 to seat the drink opening plug 40 in the plug retainer 30.

To engage the plug retainer 30, the drink opening plug 40 can be pressed downward into the plug retainer cavity 32 until the drink opening plug 40 is engaged by the notches 36 formed in the plug retainer cavity side walls 34. The notches 36 are configured to receive the drink opening plug 40 through a snap-fit style connection to retain the drink opening plug 40 in the open position. Optionally, only one of the cavity side walls 34 includes a notch 36 for retaining the drink opening plug 40. Alternative structures for retaining the drink opening plug 40 in the open position can also be used. For example, one or both of the cavity side walls 34 may include one or more projections for engaging the drink opening plug 40 in a snap-fit type connection.

Optionally, the male connector 38 can be configured to engage and retain the drink opening plug 40 in the open position in combination with or as an alternative to the features in the cavity side walls 34. For example, the drink opening plug 40 can be shaped as a female connector configured to mate with the male connector 38 through an interference or snap-fit type connection. Optionally, the male connector 38 is configured as a target to aid the consumer in aligning and inserting the drink opening plug 40 into the cavity 32 until the drink opening plug 40 engages the notches 36 and does not include any features or a shape that is configured to retain the drink opening plug 40 in the open position. While the male connector 38 is illustrated as being disposed within the plug retainer cavity 32 and the drink opening plug 40 is illustrated as having a female connector shape, it is within the scope of the present disclosure that the location of the male and female style connectors be reversed.

To move the drink opening plug 40 into the closed position of FIG. 1, the process just described is reversed. The tab 41 is lifted upward by the consumer to unseat the drink opening plug 40 from the plug retainer 30. The drink opening plug 40 is moved over the cap 12 toward the drink opening 16 and pivoted about the hinge 46. The drink opening plug 40 can then be pressed downward to engage the drink opening 16. The drink opening plug 40 and drink opening 16 can be configured to engage through a snap-fit or interference type connection.

Referring again to FIG. 3, when the consumer presses the drink opening plug 40 into the plug retainer 30 to engage the notches 36 and retain the drink opening plug 40 therein, a downward force, generally in the direction of arrow 96, is applied to the lid 10, which is concentrated in the area of the plug retainer 30. The applied downward force can cause portions of the plug retainer 30 and/or the cap 12 to flex. This induced flexing can make it more challenging for the consumer to engage the drink opening plug 40 with the notches 36 and/or may be severe enough to distort portions of the lid 10. As used herein, a downward force encompasses an applied force that is entirely vertical in the direction of the cup the lid 10 is seated on and/or an applied force that includes a vertical and a horizontal component.

The reinforcement structure 80 can be configured to decrease flexing of the lid 10 as a result of the applied downward force. In one aspect, the dimensions, shape, number, and location of the reinforcement structure 80 can be configured to strengthen the plug retainer 30 and/or the areas of the cap 12 adjacent the plug retainer 30 to resist at least a portion of the applied downward force during seating of the drink opening plug 40 in the plug retainer 30. In another aspect, the dimensions, shape, number, and location of the reinforcement structure 80 can be configured to redistribute at least a portion of the applied downward force away from the plug retainer 30 during seating of the drink opening plug 40.

Flexing of the lid as a result of the applied downward force can be particularly challenging when the lid is made from a material other than polystyrene. While lids made from polystyrene may flex to some extent during seating of the drink opening plug in the plug retainer, the flexing is typically less than that exhibited by other materials, such as polyolefins and polylactic acid, especially at higher temperatures. For example, when the lid is being used in a hot food service application, e.g. a cup holding hot coffee, flexing of the lid as a result of the applied downward force can be more pronounced for lids made using polyolefin or polylactic acid-based compositions compared to lids made using polystyrene, due to the higher HDT of polystyrene compared to these other materials.

Fillers, examples of which include talc, mica, and calcium carbonate, can be added to increase the strength and/or stiffness of a lid made from polyolefins or polylactic acid to attempt to address some of the flexing challenges. However, increasing the amount of filler can have undesirable consequences, such as increasing the density of the lid or increasing the cost of the lid. The reinforcement structures of the present disclosure can be used to increase the strength and/or stiffness of the lid in place of or in combination with other methods, such as increasing the amount of filler. The reinforcement structures can be used to provide the lid with the desired strength and/or stiffness characteristics while using less filler than would be required to obtain comparable characteristics without the reinforcement structure. The reinforcement structures of the present disclosure can be used to provide lids made without polystyrene, e.g. polyolefin or polylactic acid-based lids, with improved flexing behavior as a result of an applied downward force. The reinforcement structures can also be used with lids made using polystyrene to improve their flexing behavior.

Additional Embodiments

Figure 7:
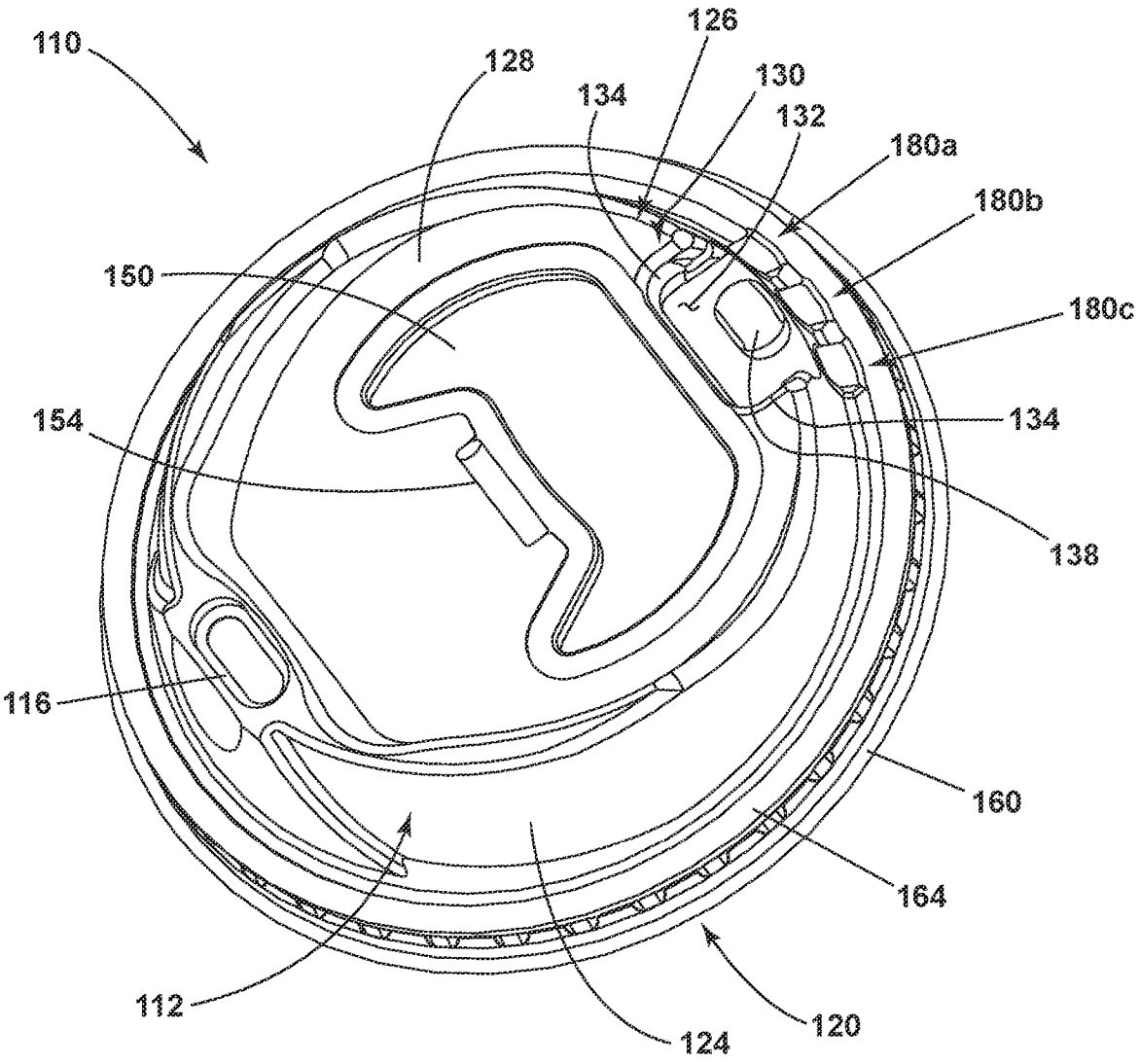
FIG. 7 is a perspective view of a recloseable lid having a reinforcement structure according to an aspect of the present disclosure.
Figure 8:
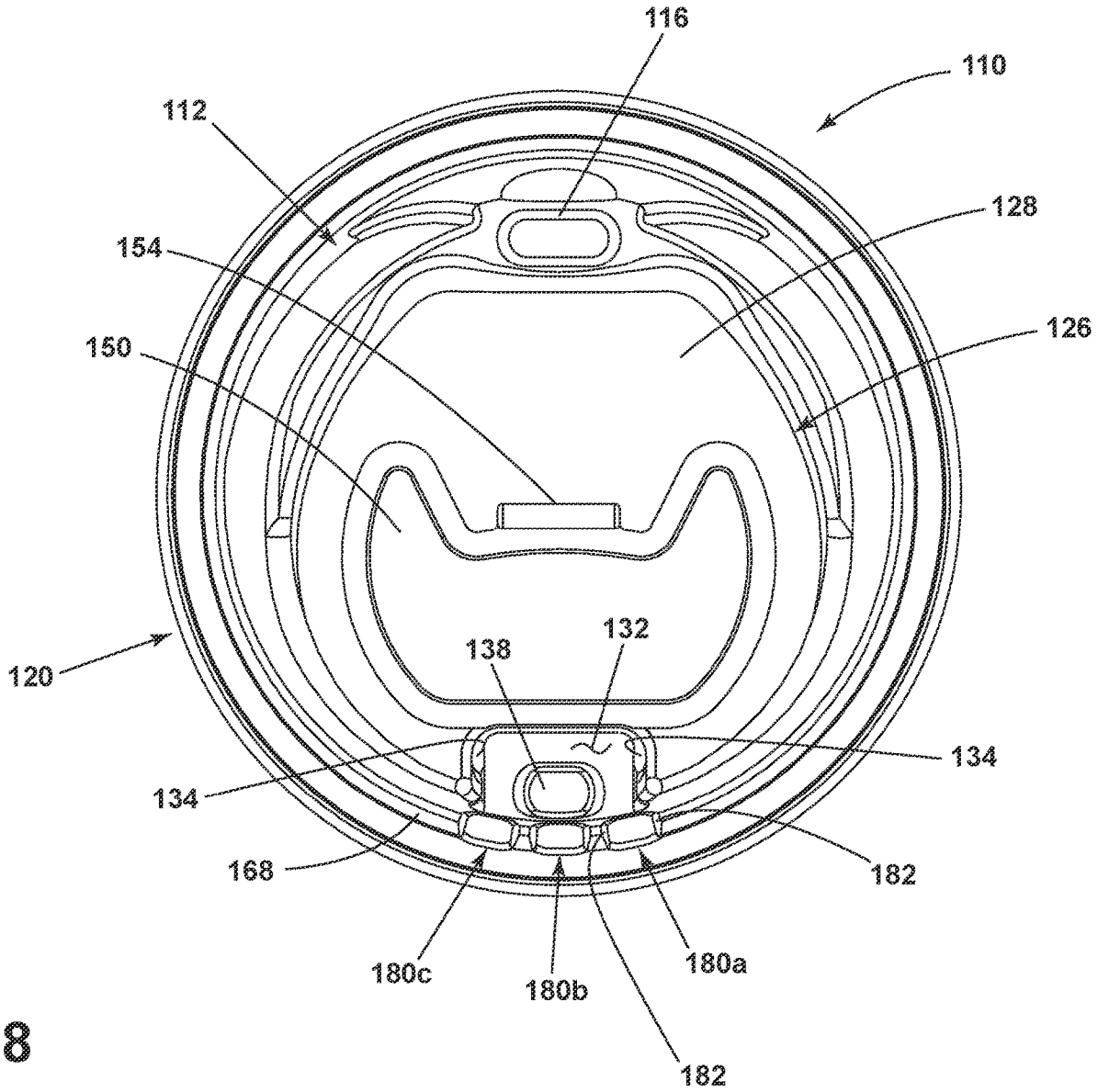
FIG. 8 is a top-down view of the recloseable lid of FIG. 7 according to an aspect of the present disclosure.

FIGS. 7-8 illustrate a lid 110 that is similar to the lid 10 of FIGS. 1-3, but includes some differences, such as the configuration of the reinforcement structure. Therefore, elements of the lid 110 that are similar to the lid 10 are labeled with the prefix 100. The lid 110 can include a drink plug assembly similar to the drink plug assembly 14 of FIGS. 1-3, but which is not shown in FIGS. 7-8 for clarity.

The lid 110 includes multiple reinforcement structures 180*a*, 180*b*, 180*c* rather than the single reinforcement structure 80 of FIG. 1. Each of the reinforcement structures 180*a-c* can be the same or different from at least one of the other reinforcement structures 180*a-c*. For example, the middle reinforcement structure 180*b* can have a width that is the same, greater than, or less than the adjacent reinforcement structures 180*a* and 180*c*. The width and spacing of the reinforcement structures 180*a-c* can be configured to have a combined total width equal to, less than, or greater than the width of the plug retainer cavity 132. While three reinforcement structures 180*a-c* are illustrated, according to an aspect of the present disclosure, the lid 110 may include only two or more than three reinforcement structures.

The reinforcement structures 180*a-c* are configured to decrease flexing of the lid 110 as a result of the applied downward force experienced by the lid 110 as the drink opening plug is pressed into engagement with the plug retainer 130. The dimensions, shape, number, and location of the reinforcement structures 180*a-c* can be configured to strengthen the plug retainer 130 and/or the areas of the lid 110 adjacent the plug retainer 130 to resist at least a portion of the applied downward force during seating of the drink opening plug in the plug retainer 130. In another aspect, the dimensions, shape, number, and location of the reinforcement structure 180 can be configured to redistribute at least a portion of the applied downward force away from the plug retainer 130 during seating of the drink opening plug.

Figure 9:
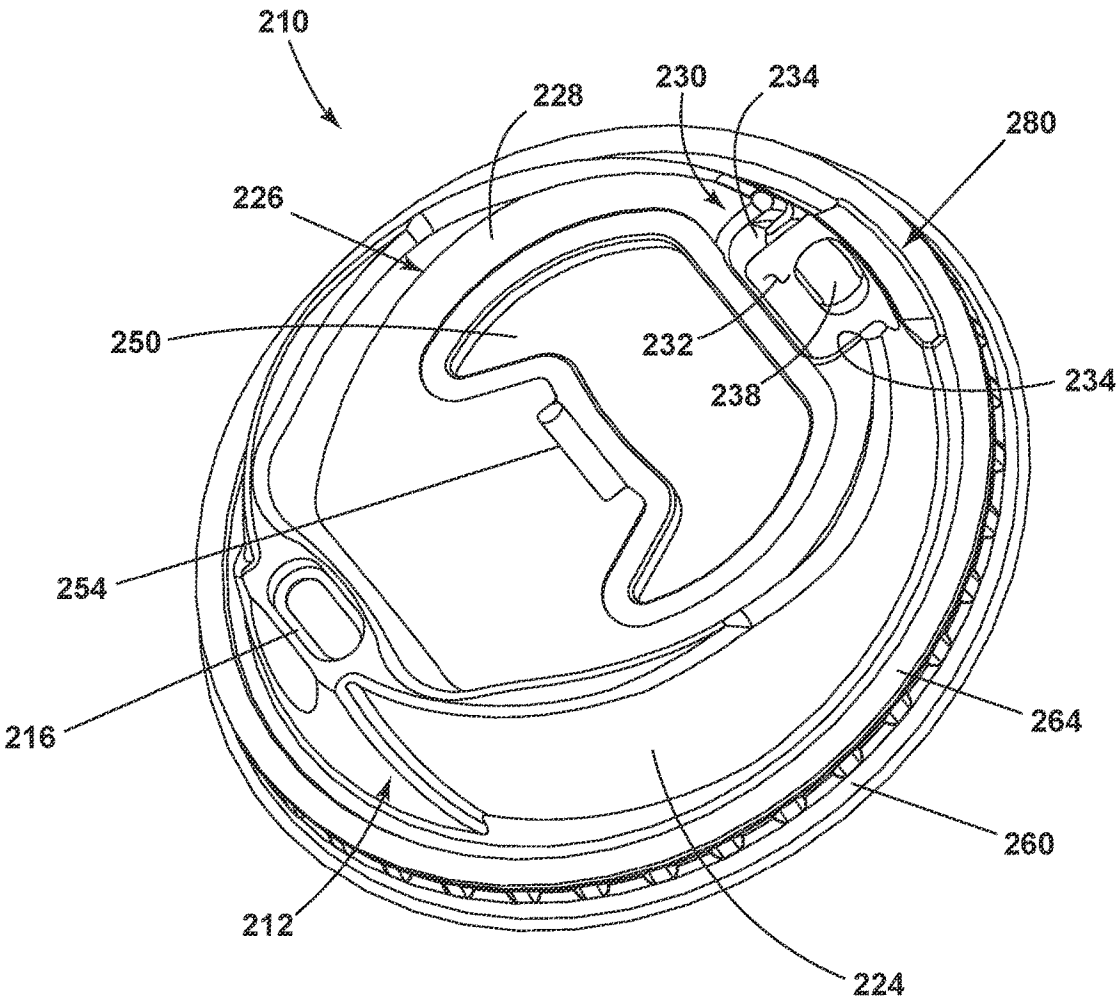
FIG. 9 is a perspective view of a recloseable lid having a reinforcement structure according to an aspect of the present disclosure.
Figure 10:
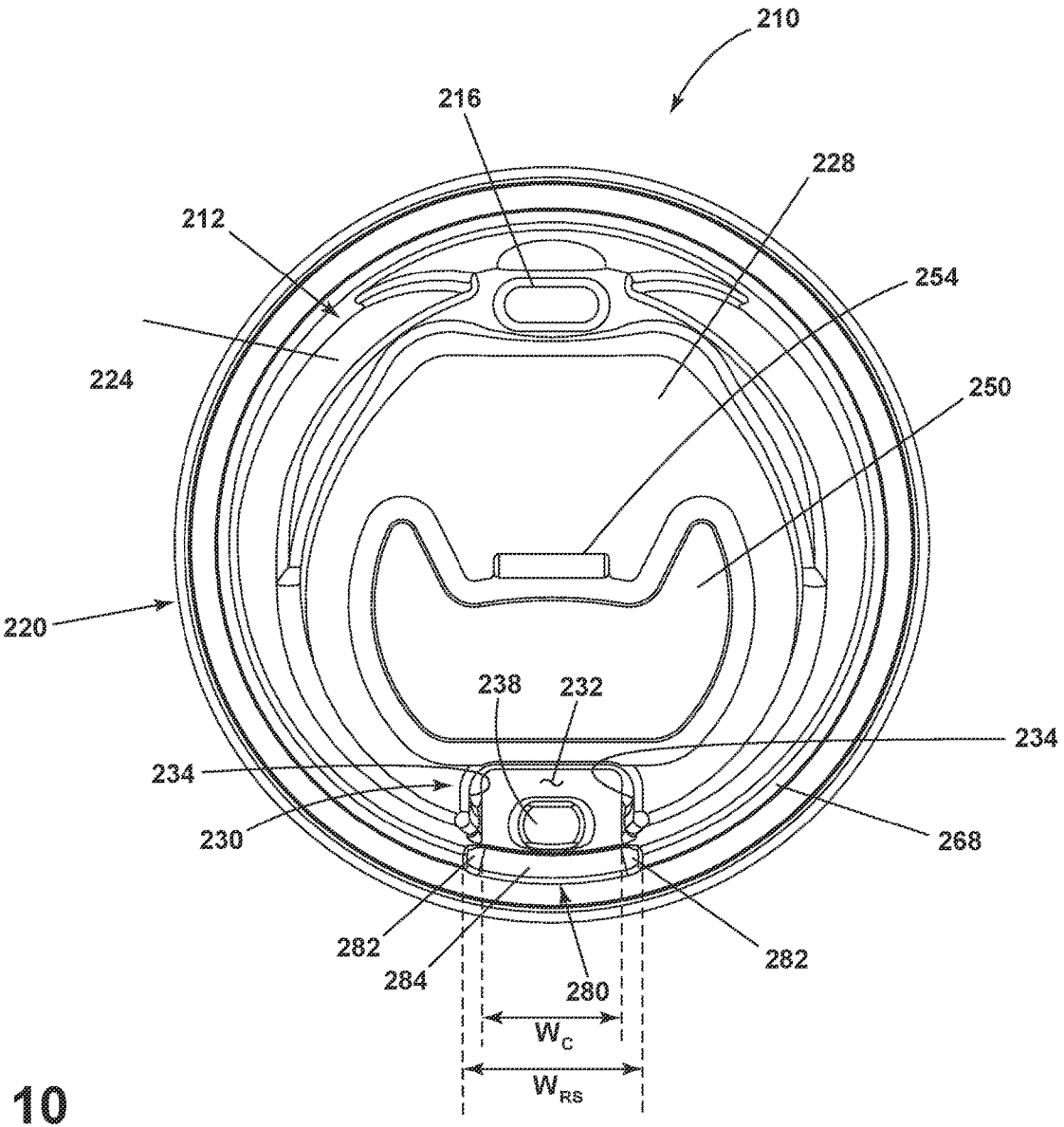
FIG. 10 is a top-down view of the recloseable lid of FIG. 9 according to an aspect of the present disclosure.

FIGS. 9-10 illustrate a lid 210 that is similar to the lid 10 of FIGS. 1-3 except for the configuration of the reinforcement structure. Therefore, elements of the lid 210 that are similar to the lid 10 are labeled with the prefix 200. The lid 210 can include a drink plug assembly similar to the drink plug assembly 14 of FIGS. 1-3, but which is not shown in FIGS. 9-10 for clarity.

The lid 210 includes a single reinforcement structure 280 having a width $W_{RS}$ that corresponds to at least a majority of the width We of the plug retainer cavity 232. According to an aspect of the present disclosure, the single reinforcement structure 280 can have a width $W_{RS}$ corresponding to at least 75%, optionally at least 85%, further optionally at least 95%, and still further optionally at least 100% of the width $W_C$ of the plug retainer cavity 232. According to another aspect of the present disclosure, a width of the top wall 284 of the reinforcement structure 280 corresponds to about 100%, optionally about 95 to 100%, further optionally about 90 to 100% of the width $W_C$ of the plug retainer cavity 232.

The reinforcement structure 280 is configured to decrease flexing of the lid 210 as a result of the applied downward force experienced by the lid 210 as the drink opening plug is pressed into engagement with the plug retainer 230. The dimensions, shape, number, and location of the reinforcement structures 280 can be configured to strengthen the plug retainer 230 and/or the areas of the lid 210 adjacent the plug retainer 230 to resist at least a portion of the applied downward force during seating of the drink opening plug in the plug retainer 230. In another aspect, the dimensions, shape, number, and location of the reinforcement structure 280 can be configured to redistribute at least a portion of the applied downward force away from the plug retainer 230 during seating of the drink opening plug.

Figure 11:
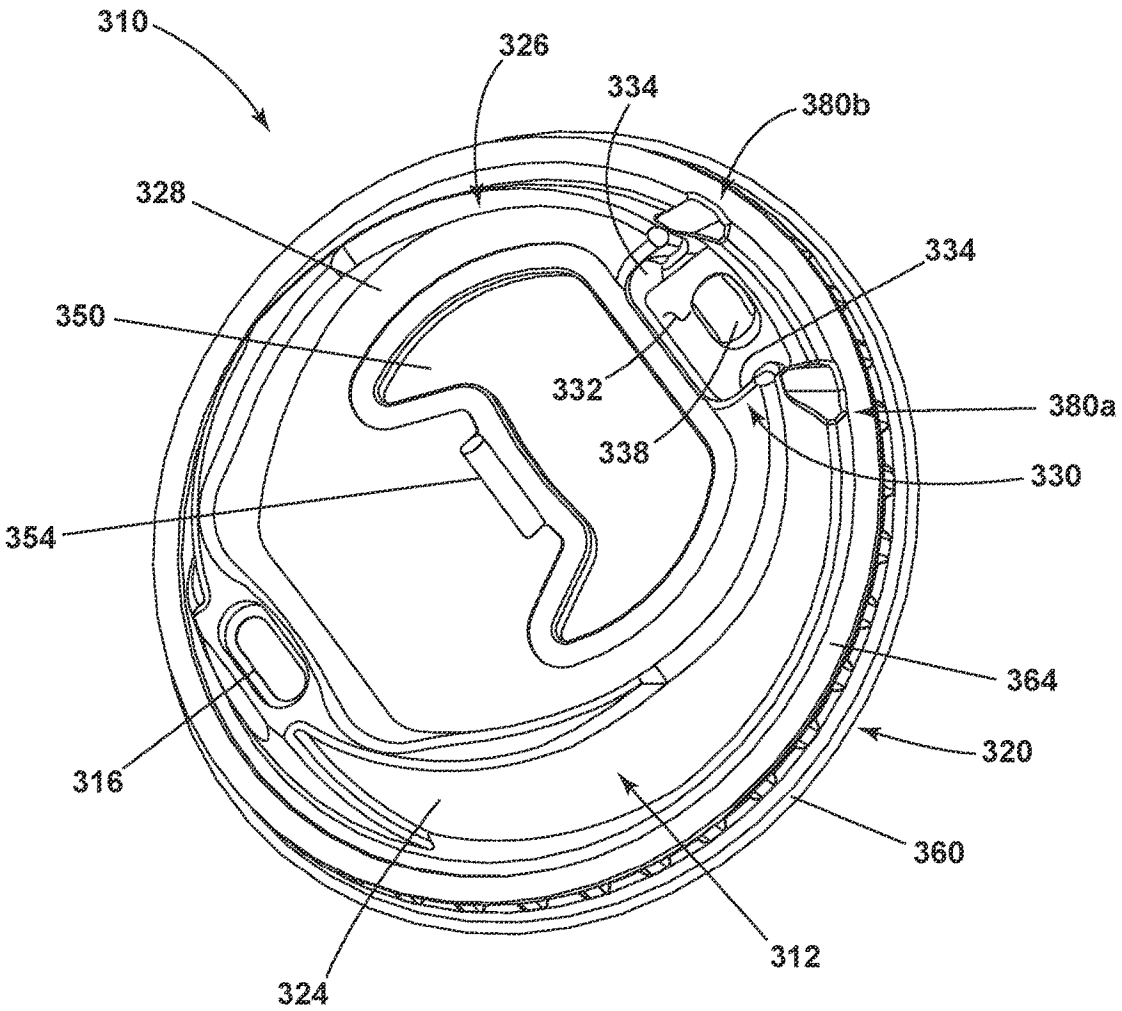
FIG. 11 is a perspective view of a recloseable lid having a reinforcement structure according to an aspect of the present disclosure.
Figure 12:
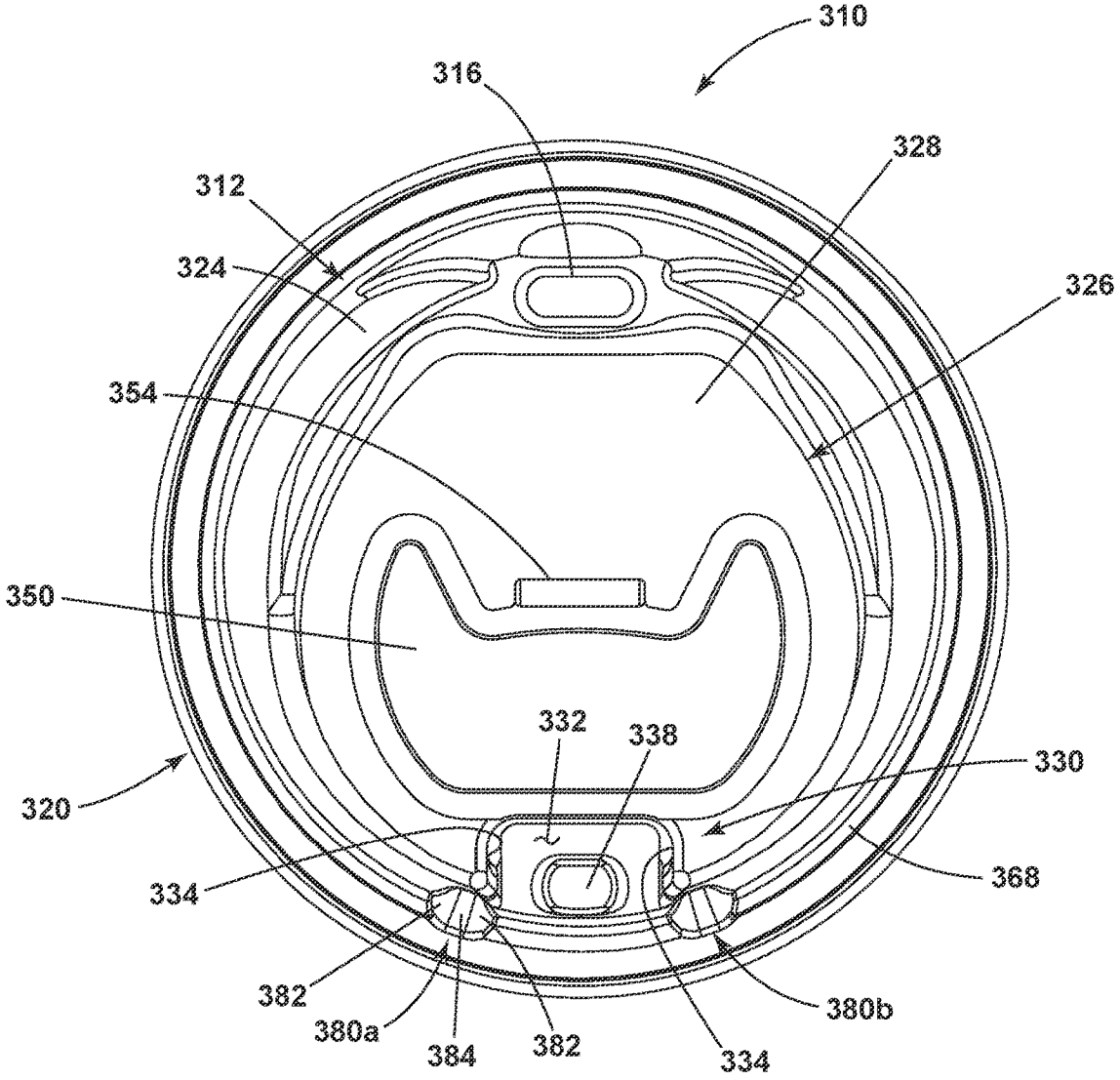
FIG. 12 is a top-down view of the recloseable lid of FIG. 11 according to an aspect of the present disclosure.

FIGS. 11-12 illustrate a lid 310 that is similar to the lid 10 of FIGS. 1-3 except for the configuration of the reinforcement structure. Therefore, elements of the lid 310 that are similar to the lid 10 are labeled with the prefix 300. The lid 110 can include a drink plug assembly similar to the drink plug assembly 14 of FIGS. 1-3, but which is not shown in FIGS. 11-12 for clarity.

The lid 310 includes a pair of reinforcement structures 380*a* and 380*b* disposed in a flanking position on either side of the plug retainer cavity 332, adjacent to each of the cavity side walls 334. The reinforcement structures 380*a* and 380*b* can be disposed adjacent the cavity side walls 334 such that at least a portion of the reinforcement structures 380*a*, 380*b* overlap with the plug retainer cavity 332. Optionally, the reinforcement structures 380*a, b* are disposed on either side of the cavity side walls 334 such that they do not overlap with the plug retainer cavity 332.

The reinforcement structures 380*a-b* are configured to decrease flexing of the lid 310 as a result of the applied downward force experienced by the lid 310 as the drink opening plug is pressed into engagement with the plug retainer 330. The dimensions, shape, number, and location of the reinforcement structures 380*a-b* can be configured to strengthen the plug retainer 330 and/or the areas of the lid 310 adjacent the plug retainer 330 to resist at least a portion of the applied downward force during seating of the drink opening plug in the plug retainer 330. In another aspect, the dimensions, shape, number, and location of the reinforcement structure 380 can be configured to redistribute at least a portion of the applied downward force away from the plug retainer 330 during seating of the drink opening plug.

Figure 13:
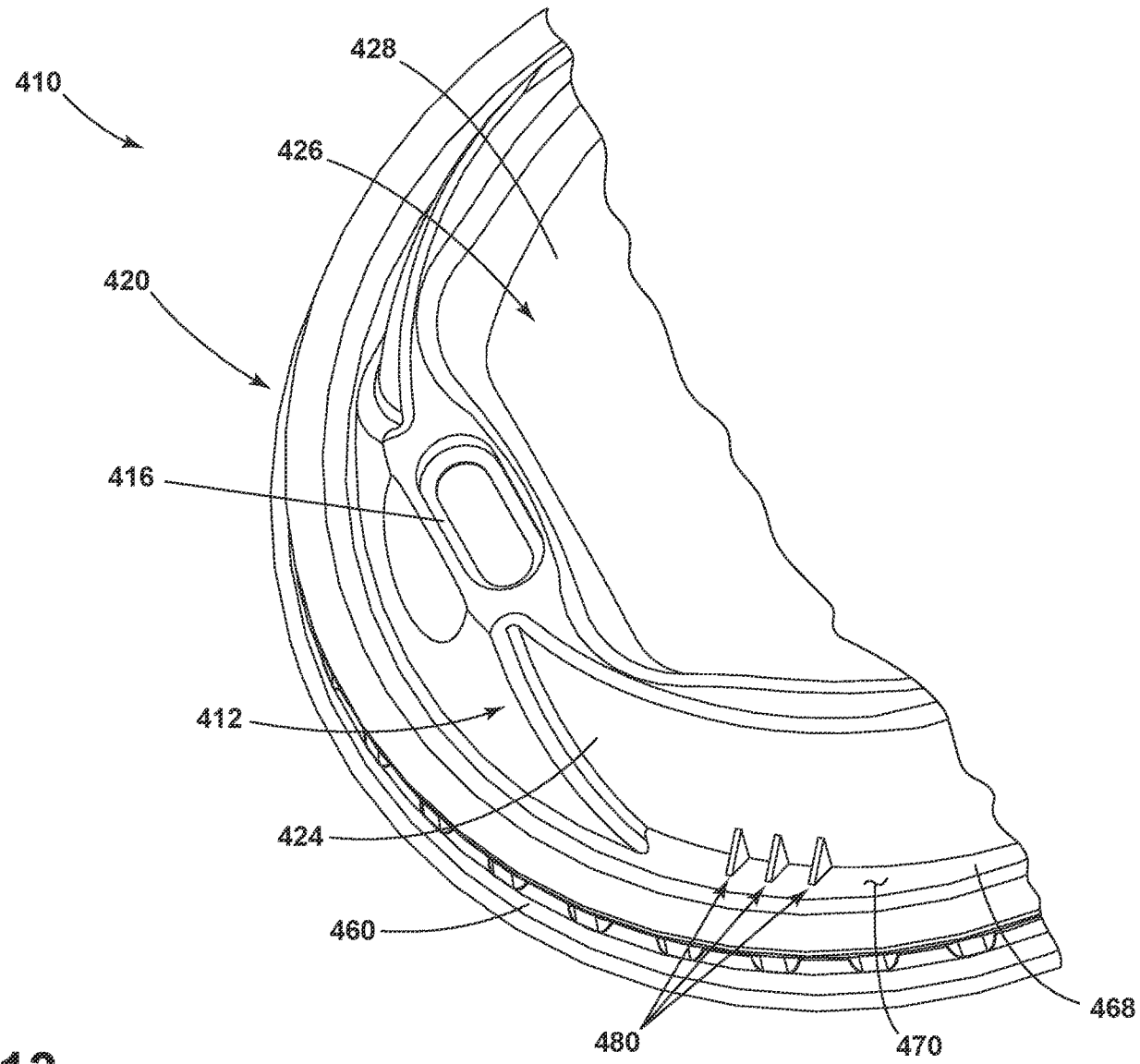
FIG. 13 is a perspective view of a portion of a lid including a plurality of reinforcement structures according to an aspect of the present disclosure.

FIG. 13 illustrates a lid 410 that is similar to the lid 10 of FIGS. 1-3, but includes some differences, such as the configuration of the reinforcement structure. Therefore, elements of the lid 410 that are similar to the lid 10 are labeled with the prefix 400. The lid 110 can include a drink plug assembly similar to the drink plug assembly 14 of FIGS. 1-3 or any other type of drink plug assembly. Optionally, the lid 410 can be used with drink opening plug in the form of a separate stopper that is configured to be inserted into the drink opening 416.

The lid 410 includes at least one reinforcement structure 480 adjacent to the drink opening 416. Optionally, multiple reinforcement structures 480 can be disposed on either side of the drink opening 416. The reinforcement structures 480 can be in the form of generally triangular gussets, as illustrated, or have any other geometric shape. According to one aspect of the present disclosure, the reinforcement structures 480 can have the same shape as the reinforcement structure 80 of FIGS. 1-3 or any of the reinforcement structures of the present disclosure.

The reinforcement structures 480 can be provided adjacent to the drink opening 416 to decrease flexing experienced by the lid 410 when a drink opening plug is pressed into engagement with the drink opening 416. The drink opening plug may be an attached plug, such as the drink opening plug 40 of FIG. 1, or a separate drink opening plug. The reinforcement structures 480 adjacent the drink opening 416 can be used alone or optionally be used with a reinforcement structure disposed adjacent a plug retainer, such as the reinforcement structure 80 adjacent the plug retainer 30 of FIG. 1. Any of the reinforcement structures described herein for use adjacent a plug retainer can be used adjacent the drink opening 416 either alone or in combination with any of the described reinforcement structures adjacent a plug retainer.

The reinforcement structures 480 are configured to decrease flexing of the lid 410 as a result of the applied downward force experienced by the lid 410 as the drink opening plug is pressed into engagement with the drink opening 416. The dimensions, shape, number, and location of the reinforcement structures 480 can be configured to strengthen the cap 412 adjacent the drink opening 416 to resist at least a portion of the applied downward force during seating of the drink opening plug into the drink opening 416. In another aspect, the dimensions, shape, number, and location of the reinforcement structure 480 can be configured to redistribute at least a portion of the applied downward force away from the areas of the cap 412 adjacent the drink opening 416 during seating of the drink opening plug into the drink opening 416.

Figure 14:
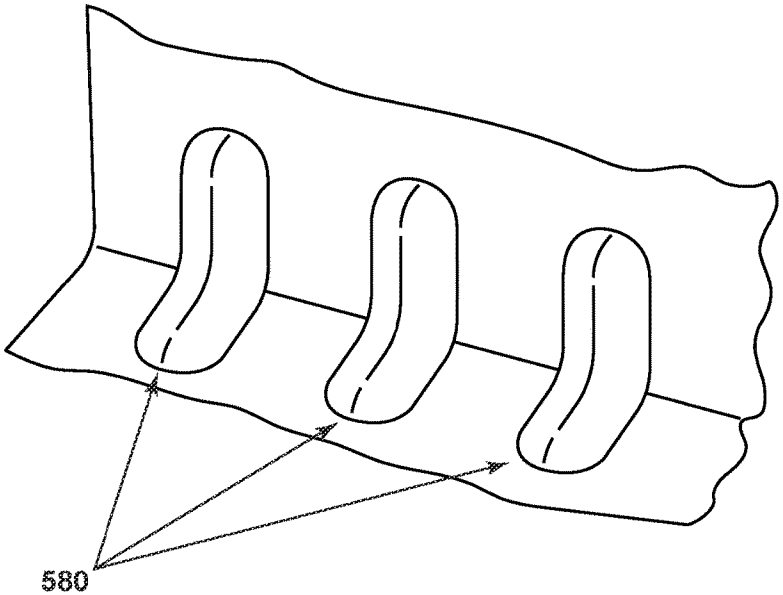
FIG. 14 is a perspective view of a portion of a lid illustrating exemplary reinforcement structures according to an aspect of the present disclosure.
Figure 15:
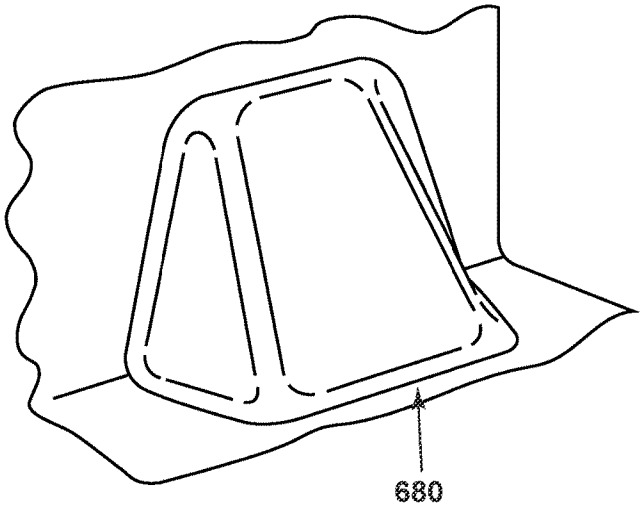
FIG. 15 is a perspective view of a portion of a lid illustrating exemplary reinforcement structures according to an aspect of the present disclosure.
Figure 16:
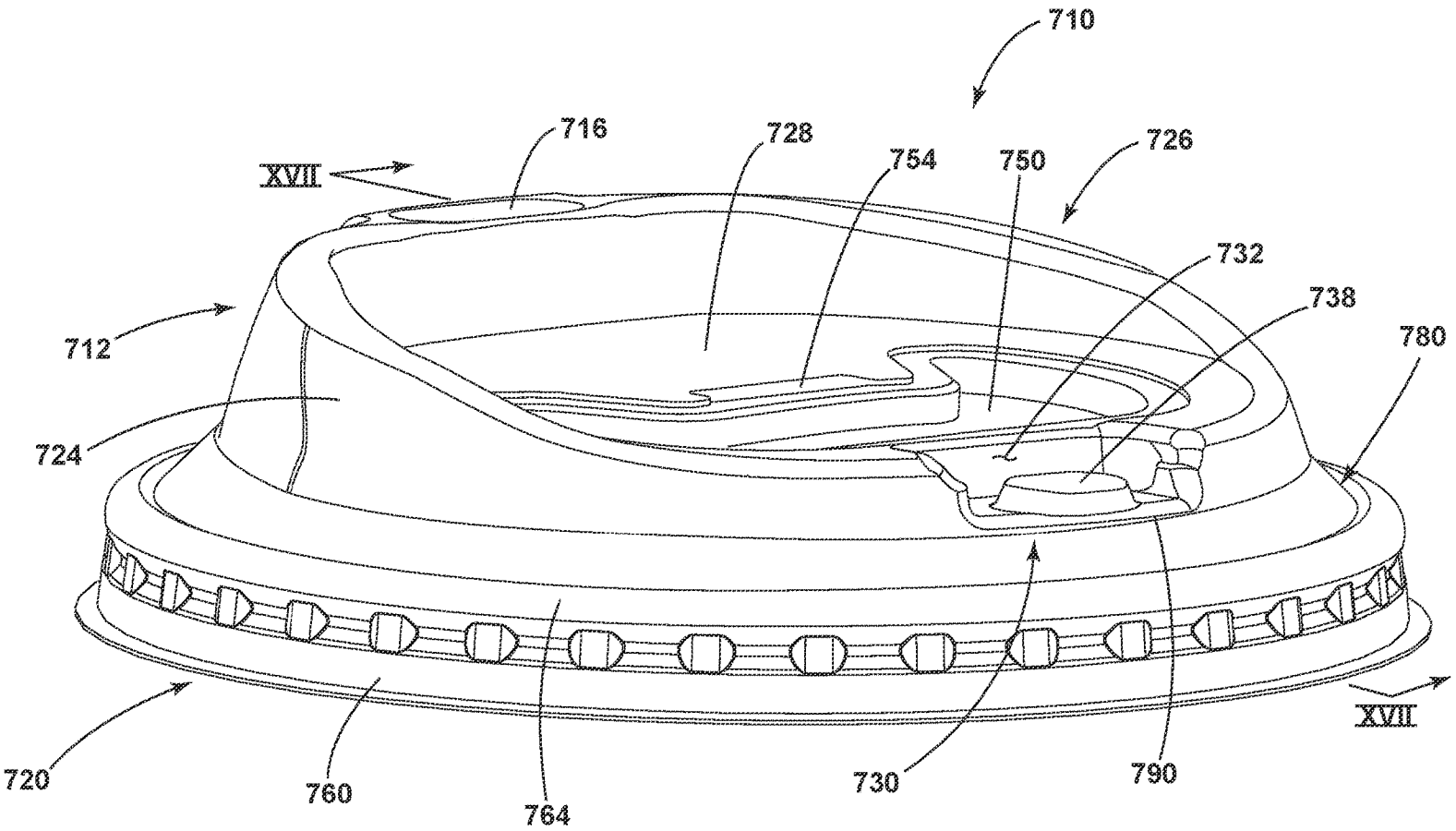
FIG. 16 is a rear perspective view of a portion of a recloseable lid having a reinforcement structure according to an aspect of the present disclosure.

FIGS. 14 and 15 illustrate additional examples of shapes of reinforcement structures 580 and 680, respectively, which can be used to decrease flexing experienced by a lid when a drink opening plug is pressed into engagement with the drink opening and/or when a drink opening plug is pressed into engagement with a plug retainer. FIG. 15 illustrates an example of a rounded gusset reinforcement structure 580 while FIG. 16 illustrates a generally trapezoidal-shaped reinforcement structure. Either of the reinforcement structures 580 and 680 can be used individually or in groups of multiples.

According to an aspect of the present disclosure, any of the reinforcement structures described herein can be used adjacent a drink opening and/or a plug retainer. When reinforcement structures are used adjacent both the drink opening and the plug retainer, the reinforcement structures may be the same or different dimensions and/or shapes based on their location.

Figure 17:
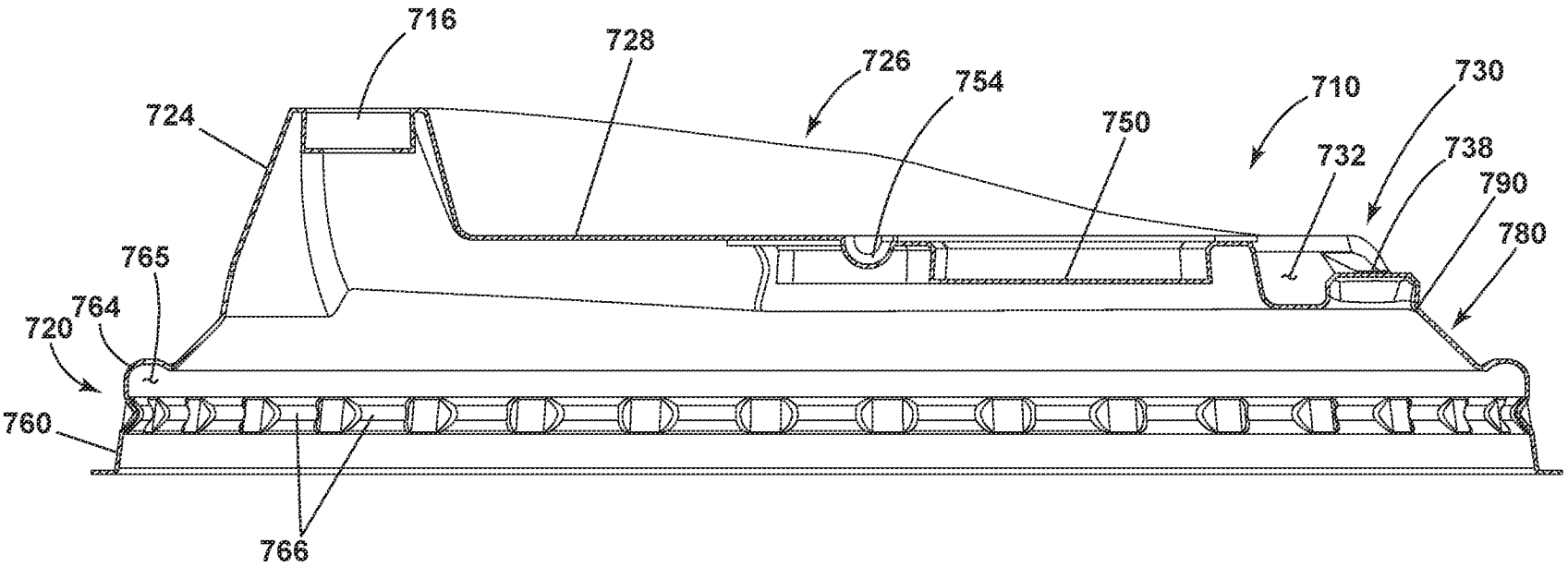
FIG. 17 is a cross-sectional view of the recloseable lid of FIG. 16 according to an aspect of the present disclosure.

FIGS. 16-17 illustrates a lid 710 that is similar to the lid 10 of FIGS. 1-3, but includes some differences, such as the configuration of the reinforcement structure. Therefore, elements of the lid 710 that are similar to the lid 10 are labeled with the prefix 700. The lid 710 can include a drink plug assembly similar to the drink plug assembly 14 of FIGS. 1-3, but which is not shown in FIGS. 16-17 for clarity.

The lid 710 includes a reinforcement structure 780 in the form of a chamfer that extends around the entire periphery of the lid 710. The reinforcement structure 780 extends between the annular side wall 724 and the cup mount 720. According to one aspect of the present disclosure, the reinforcement structure 780 spans the entire distance between the annular side wall 724 and the cup mount 720, as illustrated. Optionally, the reinforcement structure 780 can extend from the side wall 724 toward the cup mount 720, but be spaced from the cup mount 720 such that an annular floor extends between the reinforcement structure 780 and the cup mount 720. The reinforcement structure 780 can have a height such that an upper edge of the reinforcement structure 780 extends from the exterior edge 790 of the plug retainer 730 toward the cup mount 720. Optionally, the upper edge of the reinforcement structure 780 can be spaced from the exterior edge 790. While the reinforcement structure 780 is illustrated as extending around the entire periphery of the lid 710, it is also within the scope of the present disclosure for the reinforcement structure 780 to extend only part way around the periphery of the lid 710. According to one aspect, the reinforcement structure 780 extends only part way around the periphery of the lid 710, including adjacent the plug retainer 730. According to another aspect, the reinforcement structure 780 extends only part way around the periphery of the lid 710, including adjacent the drink opening 716.

The reinforcement structure 780 is configured to decrease flexing of the lid 710 as a result of the applied downward force experienced by the lid 710 as the drink opening plug is pressed into engagement with the plug retainer 730. When the reinforcement structure 780 extends all the way around the periphery of the lid 710, the reinforcement structure 780 can also decrease flexing of the lid 710 when the drink opening plug is pressed into engagement with the drink opening 716. The dimensions and shape of the reinforcement structure 780 can be configured to strengthen the plug retainer 730 and/or the drink opening 716 and adjacent areas to resist at least a portion of the applied downward force during seating of the drink opening plug in the plug retainer 730 and/or the drink opening 716. In another aspect, the dimensions and shape of the reinforcement structure 780 can be configured to redistribute at least a portion of the applied downward force away from the plug retainer 730 and/or the drink opening 716 during seating of the drink opening plug.

Figure 18:
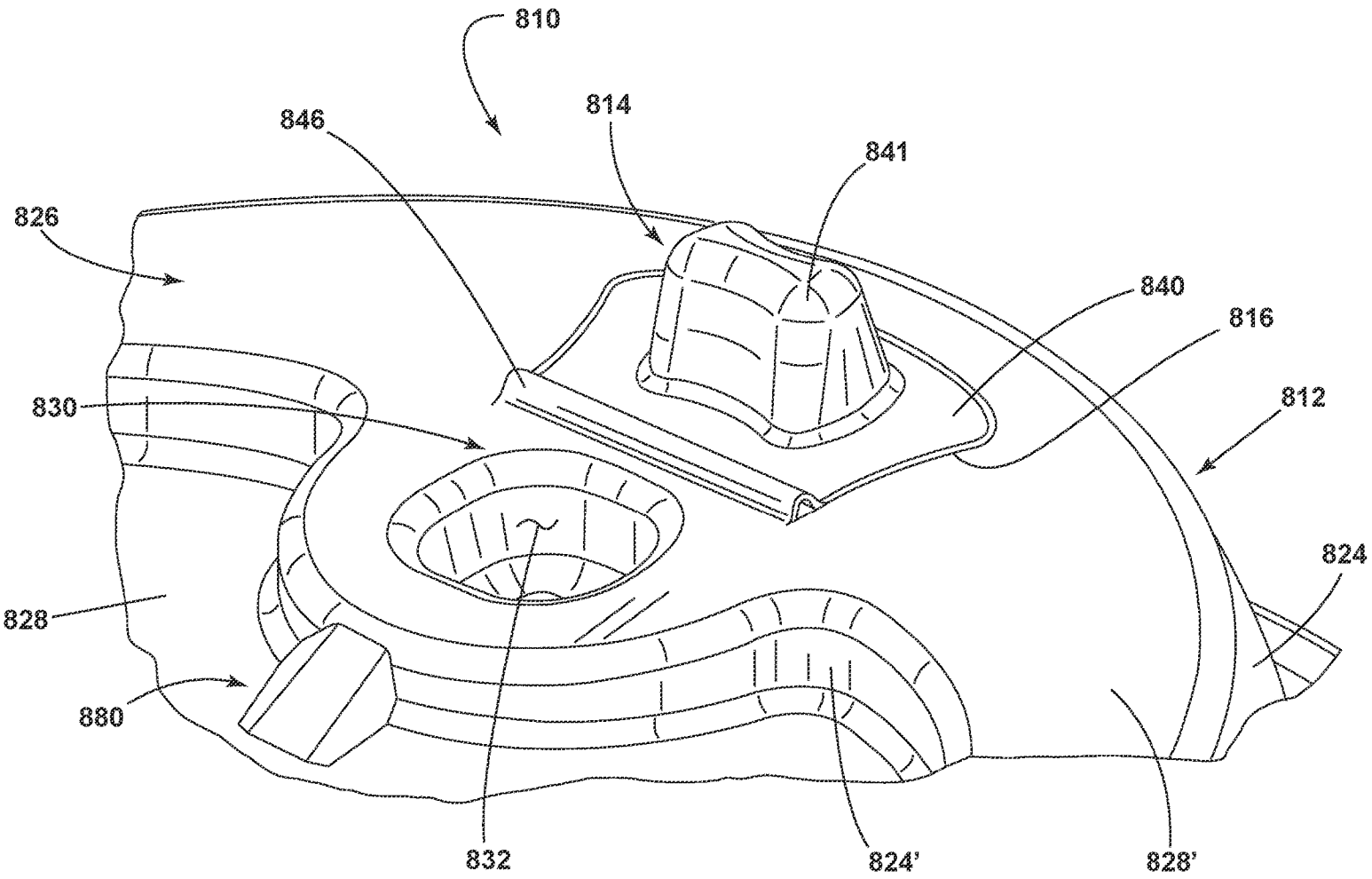
FIG. 18 is a rear perspective view of a portion of a recloseable lid having a reinforcement structure according to an aspect of the present disclosure.

FIG. 18 illustrates a lid 810 that is similar to the lid 10 of FIGS. 1-3, but includes some differences, such as the configuration of the reinforcement structure and the drink opening plug. Therefore, elements of the lid 810 that are similar to the lid 10 are labeled with the prefix 800.

The lid 810 includes a top 826 having an annular floor 828 spaced above the cup mount (not shown). The lid 810 includes a plug assembly 814 configured to selectively close the drink opening 816 formed in the lid 810 and a plug retainer 830 configured to retain the plug assembly 814 an open position when the plug assembly 814 is rotated about the hinge 846 (not shown). The plug assembly 814 includes a drink opening plug 840 that is configured to be received within the drink opening 816 when the plug assembly 814 is in the closed position of FIG. 18. The plug assembly 814 also includes a projection 841 that facilitates movement of the drink opening plug 840 about the hinge 846 by a consumer to move the plug assembly 814 between the open and closed positions.

The plug retainer 830 is in the form of a cavity 832 that is configured to receive and retain the projection 841 to retain the plug assembly 814 in the open position. The cavity 832 and the projection 841 can be configured to mate through any suitable type of connection, such as a snap-fit or interference fit type connection. In this manner, the plug retainer 830 and projection 841 can mate through a male-female style connection. While the cavity 832 is illustrated as having four walls, the cavity 832 can optionally be configured with only three walls, similar to that of the cavity 32 of FIG. 1.

The plug retainer 830 and the drink opening 816 can be disposed in a raised floor 828' that is offset above the floor 828. A secondary side wall 824' extends between at least a portion of the raised floor 828' and floor 828 adjacent to the plug retainer 830. At least one structural reinforcement 880 is disposed adjacent the plug retainer 830 extending between the plug retainer 830 and the floor 828. The reinforcement structure 880 can facilitate engagement of the drink opening plug projection 841 with the cavity 832 to secure the drink opening plug 840 in the open position. While the reinforcement structure 880 is illustrated as having a box-girder type configuration, any of the reinforcement structures of the present disclosure can be used. A single or multiple reinforcement structures 880 can be used to provide the desired support to the lid 810 when a downward force is applied during engagement of the projection 841 with the cavity 832.

FIG. 18 illustrates the cavity 832 as having four walls and being spaced from the intersection of the raised floor 828' and the secondary side wall 824' such that the reinforcement structure 880 is spaced from the cavity 832 by a portion of the raised floor 828'. According to another aspect of the present disclosure, the cavity 832 can be defined by three walls, similar to what is shown in FIG. 1. In this aspect, the secondary side wall 824' intersects with a floor of the cavity 832, thus defining a portion of the cavity 832, and the reinforcement structure 880 can extend from the secondary side wall 824' defining a portion of the cavity 832.

The reinforcement structure 880 is configured to decrease flexing of the lid 810 as a result of the applied downward force experienced by the lid 810 as the drink opening plug 840 is pressed into engagement with the plug retainer 830. The dimensions, shape, number, and location of the reinforcement structures 880 can be configured to strengthen the plug retainer 830 and/or the areas of the lid 810 adjacent the plug retainer 830 to resist at least a portion of the applied downward force during seating of the drink opening plug 840 in the plug retainer 830. In another aspect, the dimensions, shape, number, and location of the reinforcement structure 880 can be configured to redistribute at least a portion of the applied downward force away from the plug retainer 830 during seating of the drink opening plug 840.

Figure 19:
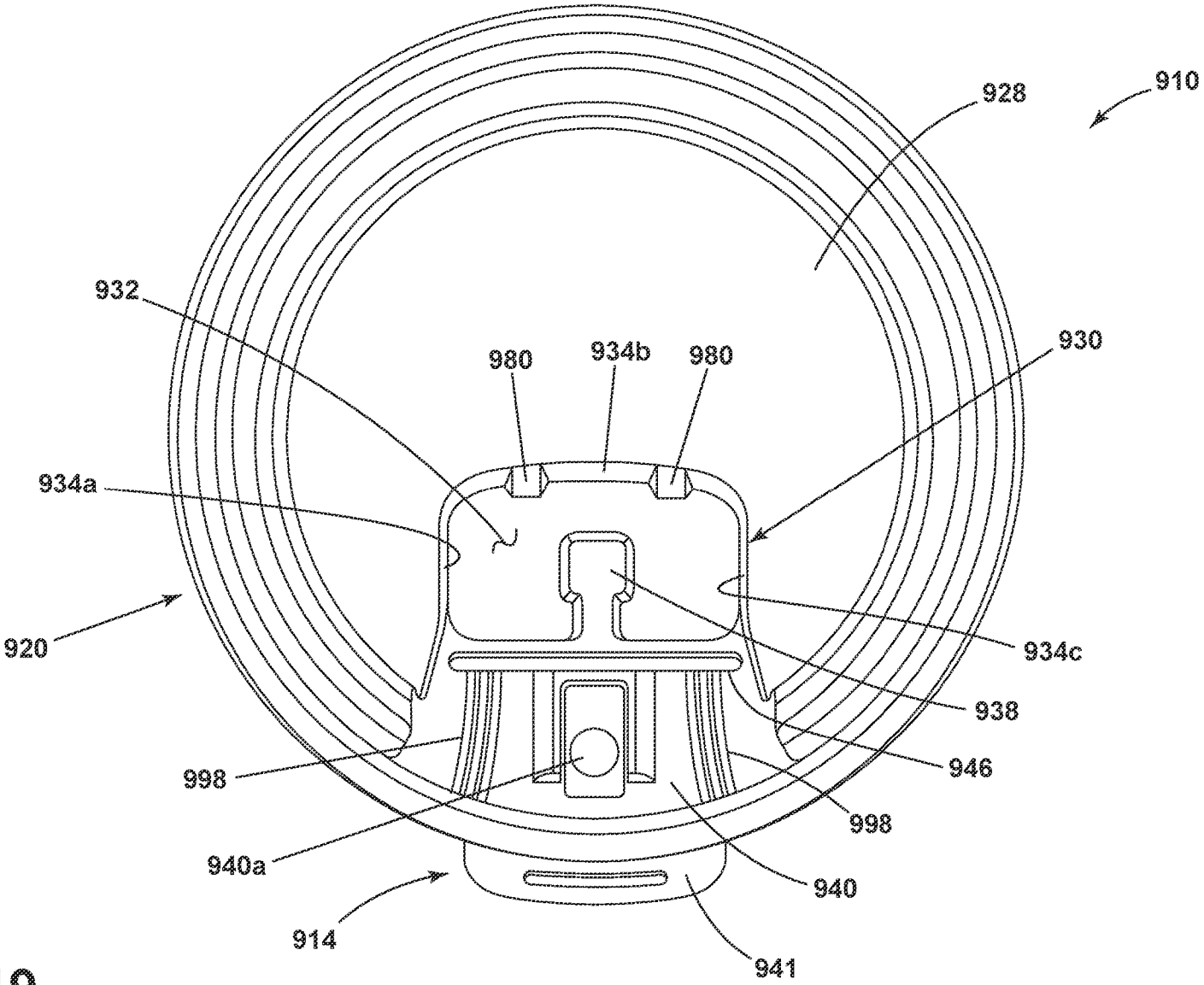
FIG. 19 is a top-down view of a recloseable lid having a reinforcement structure according to an aspect of the present disclosure.

FIG. 19 illustrates a lid 910 that is similar to the lid 10 of FIGS. 1-3, but includes some differences, such as the configuration of the reinforcement structure and the drink opening plug. Therefore, elements of the lid 910 that are similar to the lid 10 are labeled with the prefix 900.

The lid 910 is of the style generally referred to as a flat lid in which the lid floor 928 is generally in the same plane as the cup mount 920, in contrast to the dome-style lid of FIGS. 1-3 in which the lid floor 28 is spaced above the cup mount 20. The lid 910 includes a plug assembly 914 configured to selectively close the drink opening 916 that is formed in the lid 910 when a portion of the lid 910 is torn to form the drink opening 916. This type of lid is often referred to as a tear-back style lid in which the drink opening 916 is not present until a consumer tears a portion of the lid 910 to form the drink opening 916.

The plug assembly 914 includes a portion that is configured to be torn by a consumer to form the drink opening 916 with the torn portion forming the drink opening plug 940. The lid 910 optionally includes a tab 941 to facilitate grasping and tearing the lid 910 to form the drink opening 916. The lid 910 can optionally include tear-assist features 998 that facilitate tearing the lid 910 in a predetermined manner to form the drink opening 916.

The lid 910 also includes a plug retainer 930 configured to mate with the drink opening plug 940 to hold the drink opening plug 940 in the open position. The plug retainer 930 includes a cavity 932 formed in the lid floor 928 that includes a male connector 938 configured to mate with a female connector **940*a* on the drink opening plug 940 to retain the drink opening plug 940 in the open position. The male connector 938 and the female connector 940*a* can be configured to mate through any suitable type of connection, such as a snap-fit or interference fit type connection. The cavity 932 can be defined by at least three side walls 934*a-c* and one or more reinforcement structures 980 can be provided abutting and extending from one or more of the side walls 934*a-c* into the cavity 932. As shown in the example of FIG. 19, a pair of reinforcement structures 980 are provided extending from the rear side wall 934*b*. Optionally, one or more reinforcement structure 980 extend from one or both of the cavity side walls 934*a-b* as an alternative to or in addition to the reinforcement structures 980 extending from the rear side wall 934*b***.

The reinforcement structures 980 can have any shape and size according to any of the reinforcement structures described in the present disclosure to facilitate engagement of the drink opening plug 940 with the plug retainer 930. While the reinforcement structures 980 are illustrated as having a box-girder type configuration, any of the reinforcement structures of the present disclosure can be used. A single or multiple reinforcement structures 980 can be used to provide the desired support to the lid 910 when a downward force is applied during engagement of the drink opening plug 940 with the plug retainer 930.

In use, a consumer can grasp the optional tab 941 and pull the tab 941 toward the center of the lid 910 to tear the lid 910 along the optional tear-assist features 998 to form the drink opening 916. The thus formed plug assembly 914 can be rotated about an optional hinge 946 and the plug assembly 914 can be pressed into engagement with the plug retainer 930 to engage the male connector 938 with the female connector 940*a* to hold the drink opening plug 940 in the open position. The dimensions of the cavity 932 and the configuration of the reinforcement structures 980 can be configured to accommodate the portion of the cup mount 920 carried by the drink opening plug 940 such that the male and female connectors 938 and 940*a* can be engaged.

The reinforcement structures 980 can be configured to decrease flexing of the lid 910 as a result of the applied downward force experienced by the lid 910 as the drink opening plug 940 is pressed into engagement with the plug retainer 930. The dimensions, shape, number, and location of the reinforcement structures 980 can be configured to strengthen the plug retainer 930 and/or the areas of the floor 928 adjacent the plug retainer 930 to resist at least a portion of the applied downward force during seating of the drink opening plug 940 in the plug retainer 930. In another aspect, the dimensions, shape, number, and location of the reinforcement structure 980 can be configured to redistribute at least a portion of the applied downward force away from the plug retainer 930 during seating of the drink opening plug 940. While the drink opening plug 940 is illustrated as having a female connector and the plug retainer 930 is illustrated as having a male connector, the shape of the connectors can be reversed such that the drink opening plug 940 carries the male connector and the plug retainer 930 carries the female connector.

Figure 20:
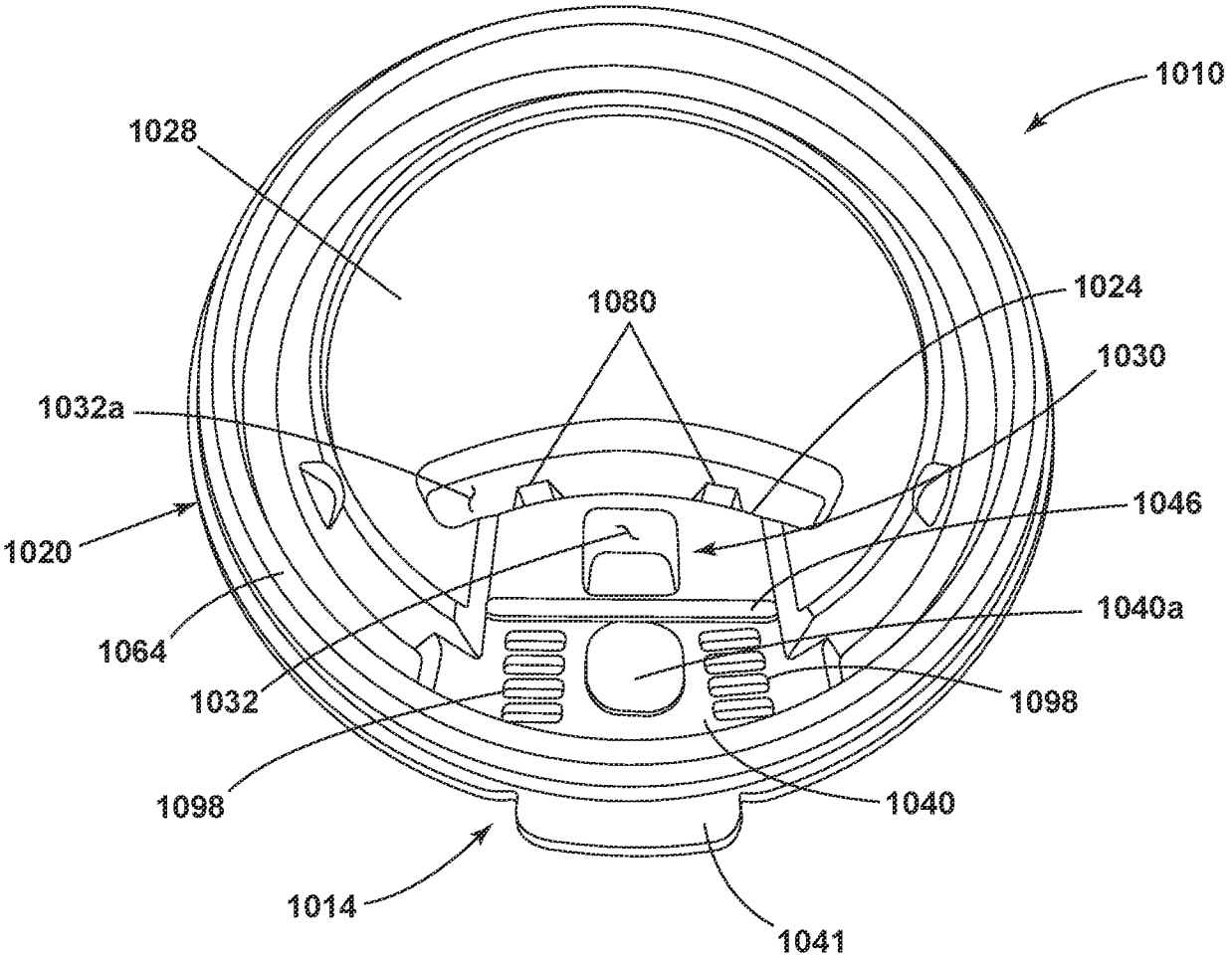
FIG. 20 is a top-down view of a recloseable lid having a reinforcement structure according to an aspect of the present disclosure.

FIG. 20 illustrates a lid 1010 that is similar to the lid 10 of FIGS. 1-3 and lid 910 of FIG. 19, but includes some differences, such as the configuration of the reinforcement structure and the drink opening plug. Therefore, elements of the lid 1010 that are similar to the lid 10 and 910 are labeled with the prefix 1000.

The lid 1010 is of the style generally referred to as a flat lid in which the lid floor 1028 is generally in the same plane as the cup mount 1020, similar to the lid 910 of FIG. 19 but in contrast to the dome-style lid 910 of FIG. 1 in which the lid floor 28 is spaced above the cup mount 20. The lid 1010 includes a plug assembly 1014 configured to selectively close the drink opening 1016 formed in the lid 1010. The lid 1010 is of the tear-back style in which a portion of the lid 1010 is torn to form the drink opening 1016.

The plug assembly 1014 includes a portion that is configured to be torn by a consumer to form the drink opening 1016, with the torn portion forming the drink opening plug 1040. The lid 1010 optionally includes a tab 1041 to facilitate grasping and tearing the lid 1010 to form the drink opening 1016. The lid 1010 can optionally include tear-assist features 1098 that facilitate tearing the lid 1010 in a predetermined manner to form the drink opening 1016.

The lid 1010 also includes a plug retainer 1030 configured to mate with the drink opening plug 1040 to hold the drink opening plug 1040 in the open position. The plug retainer 1030 includes a cavity 1032 formed in the lid floor 1028 that is configured to mate with a male connector 1040*a* on the drink opening plug 1040 to retain the drink opening plug 1040 in the open position. The male connector 1040*a* and the cavity 1032 can be configured to mate through any suitable type of connection, such as a snap-fit or interference fit type connection. The lid floor 1028 can include a channel 1028*a* adjacent to the cavity 1032 that is configured to receive the portion of the cup mount 1020 carried by the drink opening plug 1040 when the drink opening plug 1040 is pressed into engagement with the plug retainer 1030.

At least one reinforcement structure 1080 can be provided within the channel 1028*a* to facilitate engagement of the drink opening plug 1040 with the plug retainer 1030. The reinforcement structures 1080 can have any shape and dimension according to any of the reinforcement structures described in the present disclosure to facilitate engagement of the drink opening plug 1040 with the plug retainer 1030. While the reinforcement structures 1080 are illustrated as having a box-girder type configuration, any of the reinforcement structures of the present disclosure can be used. A single or multiple reinforcement structures 1080 can be used to provide the desired support to the lid 1010 when a downward force is applied during engagement of the drink opening plug 1040 with the plug retainer 1030.

FIG. 20 illustrates the cavity 1032 as being enclosed on all four sides and spaced from the channel 1032*a* by a portion of the lid floor 1028. According to one aspect of the present disclosure, the one or more reinforcement structures 1080 abut and extend from a channel wall 1024 that is directly adjacent to the cavity 1032. Optionally, the one or more reinforcement structures 1080 can extend from one or more of the other walls of the channel 1032*a* in addition to or as an alternative to extending from the channel wall 1024.

According to another aspect of the present disclosure, the cavity 1032 may only include three walls, with the cavity 1032 being open to the channel 1032*a*. In this configuration, a portion of the channel wall 1024 intersects with the bottom floor of the cavity 1032 and thus partially forms the cavity 1032. The reinforcement structures 1080 can be configured to extend from the channel wall 1024 forming a portion of the cavity 1032 and/or one or more other walls of the channel 1032*a*.

In use, a consumer can grasp the optional tab 1041 and pull the tab 1041 toward the center of the lid 1010 to tear the lid 1010 along the optional tear-assist features 1098 to form the drink opening 1016. The thus formed plug assembly 1014 can be rotated about an optional hinge 1046 and the plug assembly 1014 can be pressed into engagement with the plug retainer 1030 to engage the male connector 1040*a* with the cavity 1032 to hold the drink opening plug 1040 in the open position. The dimensions of the cavity 1032 and the configuration of the reinforcement structures 1080 can be configured to accommodate the portion of the cup mount 1020 carried by the drink opening plug 1040 such that the male connector 1040*a* and the cavity 1032 can be engaged.

The reinforcement structures 1080 are configured to decrease flexing of the lid 1010 as a result of the applied downward force experienced by the lid 1010 as the drink opening plug 1040 is pressed into engagement with the plug retainer 1030. The dimensions, shape, number, and location of the reinforcement structures 1080 can be configured to strengthen the plug retainer 1030 and/or the areas of the lid 1010 adjacent the plug retainer 1030 to resist at least a portion of the applied downward force during seating of the drink opening plug 1040 in the plug retainer 1030. In another aspect, the dimensions, shape, number, and location of the reinforcement structure 1080 can be configured to redistribute at least a portion of the applied downward force away from the plug retainer 1030 during seating of the drink opening plug 1040. While the drink opening plug 1040 is illustrated as having a male connector and the plug retainer 1030 is illustrated as having a female connector (cavity 1032), the shape of the connectors can be reversed such that the drink opening plug 1040 carries the female connector and the plug retainer 1030 carries the male connector.

FIGS. 21-22 illustrates a lid 2010 that is similar to the lid 10 of FIGS. 1-5, but includes some differences, such as the configuration of the reinforcement structure and the cup mount. Therefore, elements of the lid 2010 that are similar to the lid 10 are labeled with the prefix 2000.

The lid 2010 includes a cup mount 2020 that has an annular skirt 2060 that includes a top wall 2064 that at least partially defines a mounting recess 2065 configured to receive the rim of a container for mounting the lid 10 to the cup. The top wall 2064 can have a generally rounded or squared-off cross-sectional shape that transitions to an annular floor 2068. In contrast to the annular floor 68 of the lid 10 of FIGS. 1-5, in which the annular floor 68 is recessed below the top wall 64, the annular floor 2068 of the lid 2010 extends between the top wall 2064 and the annular sidewall 2024 generally at the same level as defined by a distal upper end of the top wall 2064. In this manner, the lid 2010 is free of a recessed annular channel extending between the cup mount 2020 and the annular side wall 2024. The cup mount 20 of FIGS. 1-5 is of the style in which a liquid-tight seal between the lid 10 and the cup upon which the lid is mounted is formed by shaping the mounting recess 2065 so as to pinch the cup rim on both an interior and exterior side of the cup rim. In contrast, the cup mount 2020 of FIGS. 21-22 is of the style in which the liquid-tight seal predominately relies on the manner in which the top wall 2064 wraps around the cup rim and the exterior mounting rib(s).

The reinforcement structure 2080 can be disposed adjacent the plug retainer 2030 extending across the annular floor 2068 between the annular side wall 2024 and the cup mount 2020 in a manner similar to that describe above with respect to the reinforcement structure 80 of the lid 10 or any of the reinforcement structures described herein. The reinforcement structure 2080 is configured to decrease flexing of the lid 2010 as a result of the applied downward force experienced by the lid 2010 as the drink opening plug is pressed into engagement with the plug retainer 2030. The dimensions, shape, number, and location of the reinforcement structure 2080 can be configured to strengthen the plug retainer 2030 and/or the areas of the lid 2010 adjacent the plug retainer 2030 to resist at least a portion of the applied downward force during seating of the drink opening plug in the plug retainer 2030. In another aspect, the dimensions, shape, number, and location of the reinforcement structure 2080 can be configured to redistribute at least a portion of the applied downward force away from the plug retainer 2030 during seating of the drink opening plug.

Figure 23:
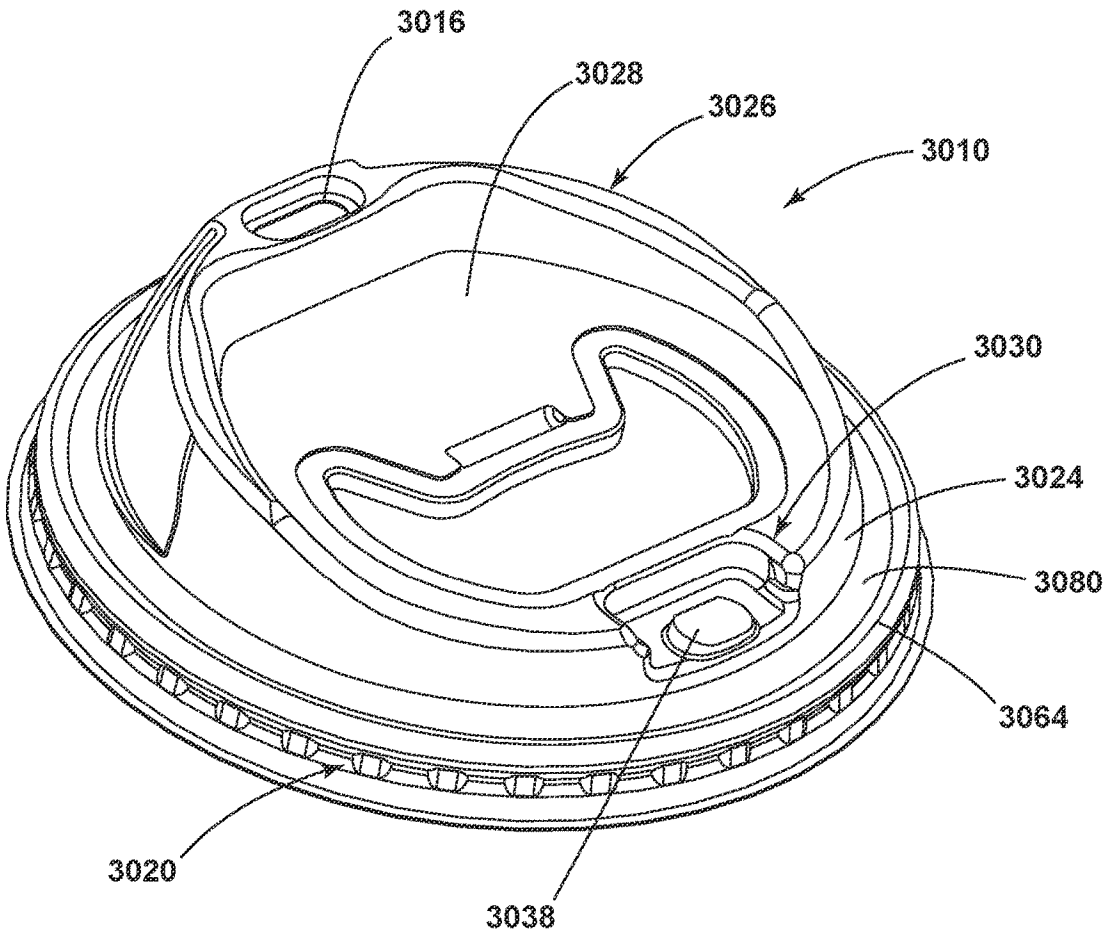
FIG. 23 is a perspective view of a recloseable lid having a reinforcement structure according to an aspect of the present disclosure.
Figure 24:
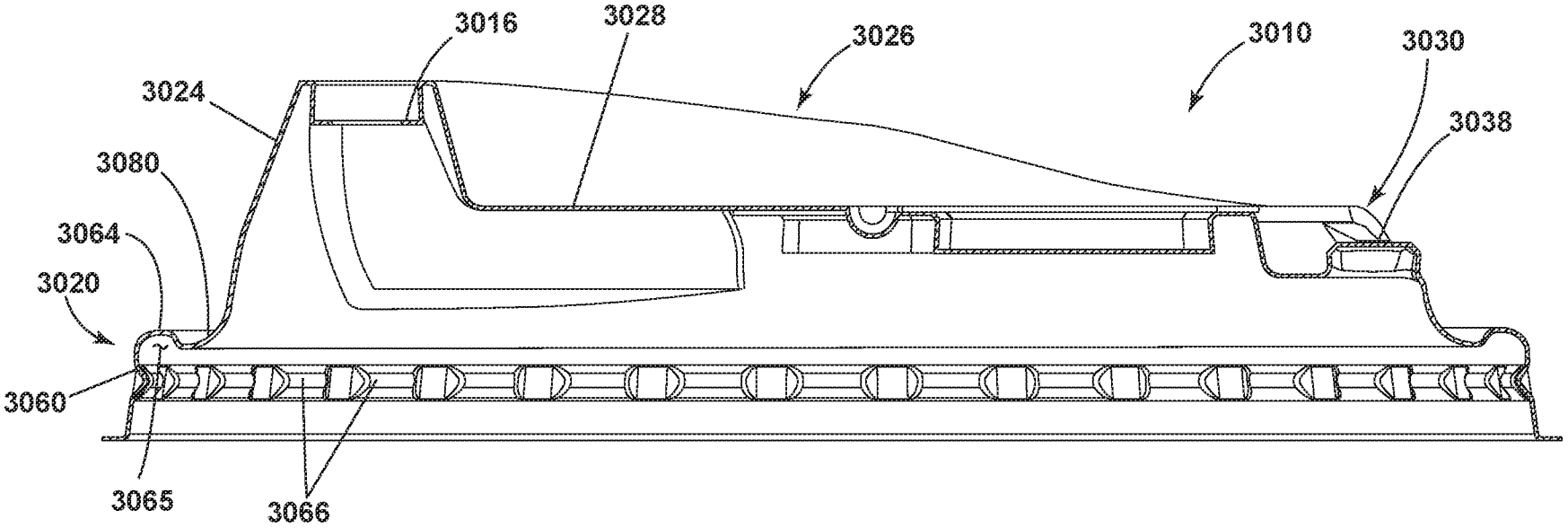
FIG. 24 is a cross-sectional view of the recloseable lid of FIG. 23 according to an aspect of the present disclosure.

FIGS. 23-24 illustrates a lid 3010 that is similar to the lid 10 of FIGS. 1-5 and 710 of FIGS. 16-17, but includes some differences, such as the configuration of the reinforcement structure and the cup mount. Therefore, elements of the lid 3010 that are similar to the lid 10 and 710 are labeled with the prefix 3000.

In contrast to the reinforcement structure 780 of the lid 710 of FIGS. 16-17, the lid 3010 includes a radiused wall 3080 extending between the annular side wall 3024 and the cup mount 3020, rather than the angled wall of the reinforcement structure 780. The radiused wall 3080 can operate as a transition from the annular side wall 3024 to the top wall 3064 of the cup mount 3020 without the recessed annular floor 68 of the lid 10 which defines the annular channel between the annular side wall 24 and the cup mount 20 of the lid 10. The radiused wall 3080 can facilitate molding of the lid 3010, particularly when the lid is made from a polyolefin-based material. The radiused wall 3080 can also provide a reinforcement feature in a manner similar to that described above with respect to the lid 10 of FIGS. 1-5 and 710 of FIGS. 16-17. Optionally, the lid 3010 includes any of the additional reinforcement structures described in the present disclosure.

Optionally, any of the lids of the present disclosure can include a stacked cup mounting configuration that is configured to fit cups having rims with different diameters. In this manner, a single lid can fit cups of different sizes. Any of the lids of the present disclosure can include a stacked skirt that includes a first rib at least partially defining a first mounting recess that is configured to receive the rim of a container having a first diameter. The lid can also include a second rib at least partially defining a second mounting recess that is configured to receive the rim of a container having a second diameter. The first mounting recess can be configured to have a diameter that is larger than the second mounting recess such that the lid can accommodate cup rims having different diameters. Optionally, the stacked skirt can include additional mounting channels such that the lid can fit cup rims having a third diameter, fourth diameter, etc.

Optionally, the stacked skirt can include a first and second series of ribs which extend around the perimeter of the lid and project inward at least partially into the adjacent mounting channels for gripping the upper edge of the cup upon which the lid is mounted. The ribs can have any of the features described herein with respect to the ribs 66 of lid 10 of FIGS. 5 and 6. The stacked skirt can be configured to be mounted to a cup according to an interference fit or a plug fit type mechanism. Optionally, the first, second, and subsequent mounting recesses are configured to mount the lid to the cup according to the same or different interference fit or plug fit mechanism. For example, lid can be configured such that the first and second mounting recesses mount the lid to the cup according to a plug fit mechanism. In another example, the lid can be configured such that one of the first and second mounting recesses mount the lid to the cup according to a plug fit mechanism and the other of the first and second mounted recesses is configured to mount the lid to the cup according to an interference fit mechanism. Optionally, the lid is configured such that the first and second mounting recesses mount the lid to the cup according to an interference fit mechanism.

To the extent not already described, the different features and structures of the various embodiments of the invention may be used in combination with each other as desired. For example, one or more of the features illustrated and/or described with respect to one of the aspects of the present disclosure can be used with or combined with one or more features illustrated and/or described with respect to the other aspects. For example, any of the reinforcement structures 80, 180, 280, 380, 480, 580, 680, 780, 880, 980, 1080, 2080, and 3080 can be used alone or in combination with any of the other reinforcement structures 80, 180, 280, 380, 480, 580, 680, 780, 880, 980, 1080, 2080, and 3080 on any of the lids 10, 110, 210, 310, 410, 710, 810, 910, 1010, 2010, and 3010 disclosed herein or with any other style lid. Any of the reinforcement structures 80, 180, 280, 380, 480, 580, 680, 780, 880, 980, 1080, 2080, and 3080 disclosed herein can be used adjacent a drink opening and/or a plug retainer of any of the lids 10, 110, 210, 310, 410, 710, 810, 910, 1010, 2010, and 3010 disclosed herein or with any other style lid. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A recloseable lid for closing an open top of a cup terminating in an annular upper edge, the lid comprising:

a cup mount defining an annular recess configured to receive the annular upper edge of the cup;

a cap having an annular side wall extending upwardly from the cup mount and terminating in a top spaced above the cup mount;

an annular floor extending between the annular side wall of the cap and the cup mount and partially defining an annular channel between the cup mount and the cap;

a drink opening disposed in the top;

a plug assembly having a drink opening plug selectively moveable between a closed position in which the drink opening plug is received within the drink opening for closing the drink opening and an open position in which the drink opening plug is not disposed within the drink opening;

a plug retainer disposed in the cap and retaining the drink opening plug in the open position; and at least one reinforcement structure located in the annular channel and extending from the cup mount to the plug retainer, and defining an exterior surface that slopes in a direction from the cup mount to the plug retainer, such that the height of the reinforcement structure relative to the annular floor is greater at the plug retainer than at the cup mount.

2. The recloseable lid of claim 1 wherein the drink opening is disposed opposite the plug retainer and wherein the at least one reinforcement member comprises a first reinforcement structure that is aligned with a centerline extending between the drink opening and the plug retainer.

3. The recloseable lid of claim 1 comprising at least one additional reinforcement member on one or both sides of the first reinforcement structure.

4. The recloseable lid of claim 1 wherein the at least one reinforcement member comprises a pair of reinforcement structures.

5. The recloseable lid of claim 1 wherein the plug retainer further comprises a cavity that is defined by opposing first and second sidewalls defining a width of the cavity.

6. The recloseable lid of claim 5 wherein the at least one reinforcement structure extends along at least a portion of the width of the cavity.

7. The recloseable lid of claim 5 wherein the at least one reinforcement structure extends along the entire width of the cavity.

8. The recloseable lid of claim 5 wherein at least one of the opposing first and second sidewalls includes a notch configured to receive a portion of the drink opening plug to retain the drink opening plug in the open position.

9. The recloseable lid of claim 1 wherein the reinforcement structure connects the plug retainer to the cup mount.

10. The recloseable lid of claim 1 wherein the reinforcement structure forms part of an annular floor extending between the plug retainer and the cup mount.

11. The recloseable lid of claim 1 wherein the at least one reinforcement structure comprises one of a ridge or gusset extending downward at an angle from the plug retainer toward the cup mount.

12. The recloseable lid of claim 1 wherein the at least one reinforcement structure is configured as a box girder that is open on one side.

13. The recloseable lid of claim 1 wherein the plug retainer comprises one of a female or male member configured to mate with the drink opening plug.

14. The recloseable lid of claim 13 wherein the plug retainer further comprises a cavity and the female or male member is disposed within the cavity.

15. The recloseable lid of claim 14 wherein the at least one reinforcement structure is one of disposed within the cavity or disposed adjacent the cavity.

16. The recloseable lid of claim 1 wherein the plug assembly includes a hinge and the drink opening plug is pivoted about the hinge to move the drink opening plug between the open and closed positions.

17. The recloseable lid of claim 1 wherein:

the plug assembly includes a mounting plug connected to the drink opening plug by a strap;

a mounting recess disposed in the annular floor and configured to receive and retain the mounting plug therein; and a hinge formed in the strap about which the drink opening plug is pivoted to move the drink opening plug between the open and closed positions.

18. The recloseable lid of claim 1 wherein the lid is made from a sheet comprising at least one polyolefin selected from the group consisting of polypropylene homopolymer, polypropylene copolymer, ethylene-propylene copolymers, polyethylene homopolymer, and combinations thereof.

19. The recloseable lid of claim 18 wherein the lid has a density of less than 1 g/cm3 at 23° C.

20. The recloseable lid of claim 18 wherein the sheet comprises at least one filler selected from the group consisting of talc, calcium carbonate, mica, wollastonite, wood fiber, paper powder, cellulose fiber, and combinations thereof.

21. The recloseable lid of claim 18 wherein the sheet is made from an extruded composition that includes a chemical blowing agent.

22. The recloseable lid of claim 18 wherein the polyolefin comprises a polypropylene homopolymer or copolymer having a flexural modulus of at least about 290,000 psi.

23. The recloseable lid of claim 18 wherein the polyolefin comprises a polypropylene homopolymer or copolymer having a heat deflection temperature of at least 95° C.

24. The recloseable lid of claim 18 wherein the sheet comprises a substrate layer comprising a first polyolefin and a cap layer comprising a second polyolefin.

25. The recloseable lid of claim 1 wherein the drink opening plug is one of integrally formed with the lid or removably connected with the lid.

26. The recloseable lid of claim 1 wherein the lid is made from a polyolefin-based composition and has a density of less than 1 g/cm3 at 23° C.

* * * * *